US006891508B2

(12) United States Patent
Inoue

(10) Patent No.: US 6,891,508 B2
(45) Date of Patent: May 10, 2005

(54) COMPOSITE ANTENNA

(75) Inventor: Jinichi Inoue, Warabi (JP)

(73) Assignee: Nippon Antena Kabushiki Kaisha, Tokyo (JP)

( * ) Notice: Subject to any disclaimer, the term of this patent is extended or adjusted under 35 U.S.C. 154(b) by 27 days.

(21) Appl. No.: 10/470,444

(22) PCT Filed: Nov. 18, 2002

(86) PCT No.: PCT/JP02/11997

§ 371 (c)(1),
(2), (4) Date: Jul. 26, 2003

(87) PCT Pub. No.: WO03/047034

PCT Pub. Date: Jun. 5, 2003

(65) Prior Publication Data

US 2004/0217907 A1 Nov. 4, 2004

(30) Foreign Application Priority Data

Nov. 28, 2001 (JP) ..... 2001-362303

(51) Int. Cl.[7] ..... H01Q 21/00
(52) U.S. Cl. ..... 343/725; 343/726
(58) Field of Search ..... 343/725, 726, 343/732, 748, 788, 802, 853, 855, 866, 873

(56) References Cited

U.S. PATENT DOCUMENTS 5,576,721 A * 11/1996 Hwang et al. ..... 343/753
5,859,618 A * 1/1999 Miller et al. ..... 343/725
6,161,761 A * 12/2000 Ghaem et al. ..... 235/492
6,313,801 B1 * 11/2001 Sanford et al. ..... 343/725
6,650,299 B2 * 11/2003 Zhang et al. ..... 343/770

FOREIGN PATENT DOCUMENTS

JP 02-214304 8/1990

OTHER PUBLICATIONS

H. Nakano, et al., "A Low–Profile Conical Beam Loop Antenna with an Electromagnetically Coupled Feed System," IEEE Transactions on Antennas and Propagation, vol. 48, No. 12 Dec. 2000 pp. 1864–1866.
T. Hikokubo, et al., "A Study on Dual–resonant Antenna for Wireless Multi–mode Terminal (B–1–174)," Electronic Information Communication Institute General Meeting 2001 p. 192.

* cited by examiner

*Primary Examiner*—Wilson Lee
*Assistant Examiner*—Minh Dieu A
(74) *Attorney, Agent, or Firm*—Kirk Hahn

(57) ABSTRACT

An object of the present invention is to provide a small composite antenna that is capable of operating in a plurality of different frequency bands. A GPS first loop antenna 2 is formed on a dielectric substrate 10. A VICS radio wave beacon second loop antenna 3 is formed on substantially the same axis within the first loop antenna 2. In addition, an ETC patch antenna 4 is formed in the bottom face of a recess 12 provided substantially in the center of the dielectric substrate 10. An earth pattern is formed over the whole of the underside of the dielectric substrate 10. An arc-shaped first feed pattern is electromagnetically coupled to the first loop antenna 2 so as to supply electricity thereto and cause same to operate as a right-handed circularly polarized antenna. An arc-shaped second feed pattern is electromagnetically coupled to the second loop antenna 3 so as to supply electricity thereto. Electricity is supplied by a coaxial cable to the patch antenna 4 to cause same to operate as a right-handed circularly polarized antenna.

34 Claims, 21 Drawing Sheets cross-section along the line A-A cross-section along the line B-B cross-section along the line A-A cross-section along the line B-B cross-section along the line A-A cross-section along the line B-B plane $\phi = 0°$ plane $\phi = 90°$ vertical polarization in the plane $\phi = 0°$ horizontal polarization in the plane $\phi = 90°$ plane $\phi = 0°$ plane $\phi = 90°$

COMPOSITE ANTENNA

This application is the U.S. National Phase under 35 U.S.C. §371 of International Application PCT/JP02/11997, filed Nov. 18, 2002, which claims priority of Japanese Patent Application No. 2001-362303, filed Nov. 28, 2001. The International Application was published under PCT Article 21(2) in a language other than English.

TECHNICAL FIELD

The present invention relates to a composite antenna in which an antenna which operates in a first frequency band, an antenna which operates in a second frequency band which is higher than the first frequency band, and an antenna which operates in a third frequency band which is higher than the second frequency band are formed on the same substrate.

BACKGROUND ART

The short range communication system known as DSRC (Dedicated Short Range Communication) is known. DSRC is a wireless communication system with a radio wave range from a few meters to several tens of meters, and is used in ETC (Electronic Toll Collection Systems), and ITS (Intelligent Transport Systems). ETC is a system in which communications take place between antennae installed on gates and on-board equipment mounted in vehicles and charges are paid automatically when vehicles pass charge points on highways and so forth. When ETC is adopted, there is no need to stop at the charge points and hence the time required for vehicles to pass gates is dramatically reduced. Such a system therefore enables traffic congestion in the vicinity of the charge points to be alleviated and exhaust gases to be reduced.

Further, ITS is a traffic system which fuses a system enabling greater vehicle intelligence such as car navigation systems (referred to as 'Car Navigation System' hereinafter) with a system enabling superior roadway intelligence such as area traffic control systems. For example, Car Navigation System include systems permitting a hookup with a VICS (Vehicle Information and Communication System). When ITS is used in such a case, general route information gathered by the police and highway information which is collected by the Tokyo Expressway Public Corporation and the Japan Highway Public Corporation is edited and transmitted by a VICS center. Then, when this information is received by a Car Navigation System, a route such as one that enables traffic congestion to be avoided can be sought and displayed on a monitor.

Further, where DSRC is concerned, information is transmitted in this way from wireless communication equipment which is provided at the side of the roadway and in parking facilities and so forth. A DSRC antenna enabling radio waves transmitted from the wireless communication equipment to be received is mounted in a vehicle fitted with a Car Navigation System. DSRC uses the 5.8 GHz band. Also, a GPS antenna is required for a Car Navigation System and a GPS antenna is therefore installed in the vehicle. The GPS uses the 1.5 GHz band. Further, in order to hook up the Car Navigation System with the VICS, a VICS antenna is necessary and hence a VICS antenna is mounted in the vehicle. The VICS (radio wave beacon) uses the 2.5 GHz band.

Thus, because the respective usage frequency bands of the DSRC, GPS and VICS are different, the corresponding antennae must be installed in the vehicle. There is therefore the problem that a plurality of antennae is required, same occupying a broad mount area, and the work involved in mounting a plurality of antennae is complicated.

An object of the present invention is therefore to provide a small composite antenna that is capable of operating in a plurality of different frequency bands.

DISCLOSURE OF THE INVENTION

In order to achieve the above object, the first composite antenna according to the present invention comprises: a first loop antenna which operates in a first frequency band and which is formed in the upper surface of a dielectric substrate; a second loop antenna which operates in a second frequency band that is higher than the first frequency band and which is formed within the first loop antenna; and a patch antenna which operates in a third frequency band that is higher than the second frequency band and which is formed within the second loop antenna, wherein a first earth pattern for the first loop antenna and second loop antenna is formed in the underside of the dielectric substrate, a recess being formed substantially in the center thereof; and a pattern formed in the bottom face of the recess constitutes a second earth pattern for the patch antenna.

Further, according to the first composite antenna of the present invention, a constitution is possible in which the dielectric substrate is formed by combining a plurality of print substrates; a through-hole for the formation of the recess is formed substantially in the center of a print substrate that lies uppermost, respective patterns for the first loop antenna and second loop antenna being formed in the upper surface of this substrate on substantially the same axis; a through-hole for the formation of the recess is formed substantially in the center of an intermediate print substrate, a first feed pattern which is electromagnetically coupled to the first loop antenna and a second feed pattern which is electromagnetically coupled to the second loop antenna being formed in the upper surface of the intermediate print substrate; and a pattern for the patch antenna is formed in the upper surface of a print substrate that lies lowermost, the earth pattern being formed in the underside of this substrate.

In addition, according to the first composite antenna of the present invention, a constitution is possible in which the dielectric substrate is formed by combining a plurality of print substrates, respective patterns for the first loop antenna, second loop antenna and patch antenna being formed in the upper surface of a print substrate that lies uppermost; the second earth pattern is formed in the underside of this substrate so as to lie opposite the patch antenna; a through-hole for the formation of the recess is formed substantially in the center of an intermediate print substrate, a first feed pattern which is electromagnetically coupled to the first loop antenna and a second feed pattern which is electromagnetically coupled to the second loop antenna being formed in the upper surface of the intermediate print substrate; and a through-hole for the formation of the recess is formed substantially in the center of a print substrate that lies lowermost, the first earth pattern being formed in the underside of this substrate.

Furthermore, according to the first composite antenna of the present invention, a constitution is possible in which a pattern that connects the second earth pattern and the first earth pattern is formed in the circumferential wall face of the recess.

Next, the second composite antenna according to the present invention that allows the above object to be achieved comprises: a first loop antenna which operates in a first frequency band, and which is formed in the upper surface of a dielectric substrate having a recess provided substantially in the center thereof so as to surround the recess; a second loop antenna which operates in a second frequency band that is higher than the first frequency band, and which is formed within the first loop antenna so as to surround the recess; and a patch antenna which operates in a third frequency band that is higher than the second frequency band and which is formed in the bottom face of the recess, wherein an earth pattern is formed in the underside of the dielectric substrate.

Further, according to the second composite antenna of the present invention, a constitution is possible in which the first loop antenna, second loop antenna and patch antenna are formed on substantially the same axis; the first loop antenna is constituted as a circularly polarized antenna by forming a pair of opposing perturbation elements on the first loop antenna; the second loop antenna is constituted as a linearly polarized antenna; and the patch antenna is constituted as a circularly polarized antenna by forming a pair of opposing degeneracy separation elements on the patch antenna.

Further, according to the second composite antenna of the present invention, a constitution is possible in which the dielectric substrate is formed by combining a plurality of print substrates; a through-hole for the formation of the recess is formed substantially in the center of a print substrate that lies uppermost, respective patterns for the first loop antenna and second loop antenna being formed in the upper surface of this substrate on substantially the same axis; a through-hole for the formation of the recess is formed substantially in the center of an intermediate print substrate, a first feed pattern which is electromagnetically coupled to the first loop antenna and a second feed pattern which is electromagnetically coupled to the second loop antenna being formed in the upper surface of the intermediate print substrate; and a pattern for the patch antenna is formed in the upper surface of a print substrate that lies lowermost, the earth pattern being formed in the underside of this substrate.

Next, the third composite antenna according to the present invention that allows the above object to be achieved comprises: a first loop antenna which operates in a first frequency band, and which is formed in the upper surface of a dielectric substrate having a first recess provided substantially in the center thereof so as to surround the first recess; a second loop antenna which operates in a second frequency band that is higher than the first frequency band, and which is formed within the first loop antenna so as to surround the first recess; and a patch antenna which operates in a third frequency band that is higher than the second frequency band and which is formed in the bottom face of the first recess, wherein a first earth pattern for the first loop antenna and second loop antenna is formed in the underside of the dielectric substrate, a second recess being formed substantially in the center of this substrate, and a pattern formed in the bottom face of the second recess constitutes a second earth pattern for the patch antenna.

Further, according to the third composite antenna of the present invention, a constitution is possible in which the first loop antenna, second loop antenna and patch antenna are formed on substantially the same axis; the first loop antenna is constituted as a circularly polarized antenna by forming a pair of opposing perturbation elements on the first loop antenna; the second loop antenna is constituted as a linearly polarized antenna; and the patch antenna is constituted as a circularly polarized antenna by forming a pair of opposing degeneracy separation elements on the patch antenna.

In addition, according to the third composite antenna of the present invention, a constitution is possible in which the dielectric substrate is formed by combining a plurality of print substrates; a through-hole for the formation of the first recess is formed substantially in the center of a print substrate that lies uppermost, respective patterns for the first loop antenna and second loop antenna being formed in the upper surface of this substrate around the through-hole; a through-hole for the formation of the first recess is formed substantially in the center of a first intermediate print substrate, a first feed pattern which is electromagnetically coupled to the first loop antenna and a second feed pattern which is electromagnetically coupled to the second loop antenna being formed in the upper surface of the intermediate print substrate; a pattern for the patch antenna is formed in the upper surface of a second intermediate print substrate, the second earth pattern being formed in the underside of this substrate so as to lie opposite the patch antenna; and a through-hole for the formation of the second recess is formed substantially in the center of a print substrate that lies lowermost, the first earth pattern being formed in the underside of this substrate.

Moreover, according to the third composite antenna of the present invention, a constitution is possible in which a pattern that connects the second earth pattern and the first earth pattern is formed in the circumferential wall face of the second recess.

Furthermore, according to the first to third composite antennae of the present invention, a constitution is possible in which a third loop antenna which operates in the third frequency band and which comprises perturbation elements is formed in place of the patch antenna.

In addition, according to the first to third composite antennae of the present invention, a constitution is possible in which a spiral antenna which operates in the third frequency band is formed in place of the patch antenna.

The fourth composite antenna according to the present invention that allows the above object to be achieved comprises: a first loop antenna which operates in a first frequency band and which is formed in the upper surface of a dielectric substrate; a second loop antenna which operates in a second frequency band that is higher than the first frequency band and which is formed within the first loop antenna; and a helical antenna which operates in a third frequency band that is higher than the second frequency band and which is formed substantially in the center of the dielectric substrate, wherein an earth pattern is formed in the underside of the dielectric substrate.

According to the present invention, because a second loop antenna which operates in a second frequency band and a patch antenna which operates in a third frequency band are formed within a first loop antenna which operates in a first frequency band, a small composite antenna which operates in three different frequency bands can be obtained. Accordingly, because, according to the present invention, a space in the first loop antenna which operates in the first frequency band is used to form a second loop antenna which operates in the second frequency band, and a space in the second loop antenna is used to form a patch antenna which operates in a third frequency band, a small composite antenna can be obtained, and the mount area thereof can be reduced and handling thereof facilitated.

Further, because the first loop antenna, second loop antenna and patch antenna are provided on substantially the same axis, it is possible to inhibit the mutual influence of the antennae. In addition, when the patch antenna is provided with degeneracy separation elements, a DSRC circularly polarized antenna for ETC and the like can be implemented, and, by providing the first loop antenna with perturbation elements to constitute a circularly polarized antenna, a GPS antenna can be produced. The second loop antenna can also be a VICS linearly polarized antenna.

BRIEF DESCRIPTION OF THE DRAWINGS

FIG. 44(*b*) is a planar view showing the constitution of a modified example of the composite antenna according to the second embodiment of the present invention; and FIG. 44(*c*) is a planar view showing the constitution of a modified example of the composite antenna according to the third embodiment of the present invention;

BEST MODE FOR CARRYING OUT THE INVENTION

Figure 1:
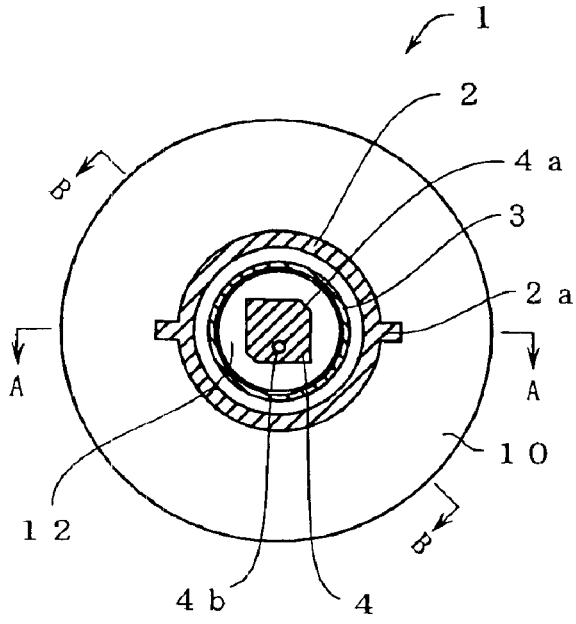
FIG. 1 is a planar view of the constitution of the composite antenna according to a first embodiment of the present invention.
Figure 2:
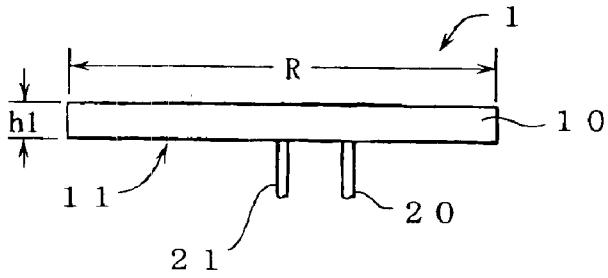
FIG. 2 is a side view of the constitution of the composite antenna according to the first embodiment of the present invention.
Figure 3:
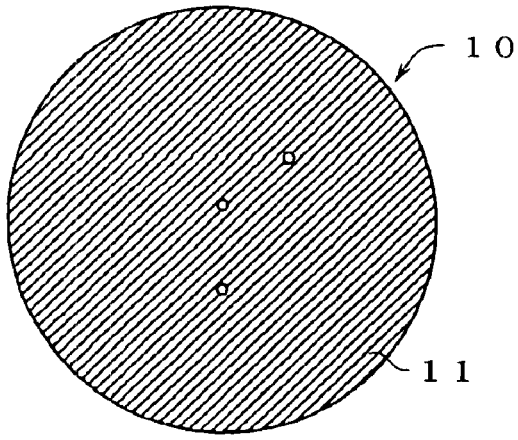
FIG. 3 is a rear view of the constitution of the composite antenna according to the first embodiment of the present invention.
Figure 4:
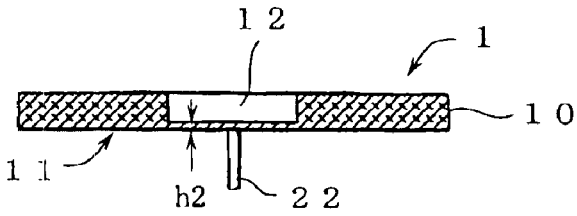
FIG. 4 is a cross-sectional view along the line A—A of the constitution of the composite antenna according to the first embodiment of the present invention.
Figure 5:
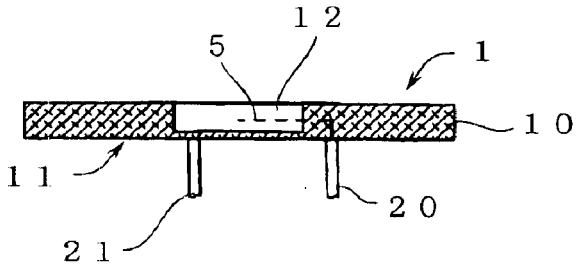
FIG. 5 is a cross-sectional view along the line B—B of the constitution of the composite antenna according to the first embodiment of the present invention.
Figure 6:
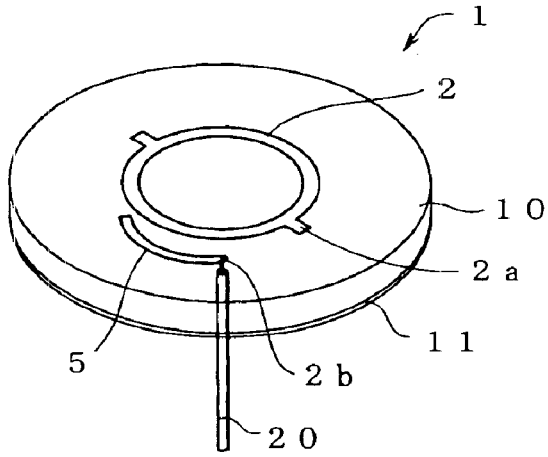
FIG. 6 is a perspective view of a feed structure for the first loop antenna according to the first embodiment of the present invention.
Figure 7:
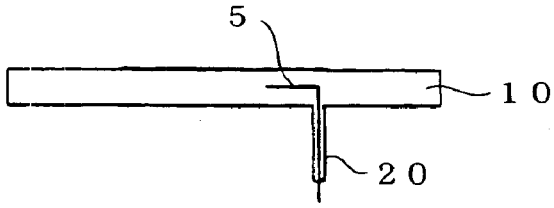
FIG. 7 is a side view of the feed structure for the first loop antenna according to the first embodiment of the present invention.
Figure 8:
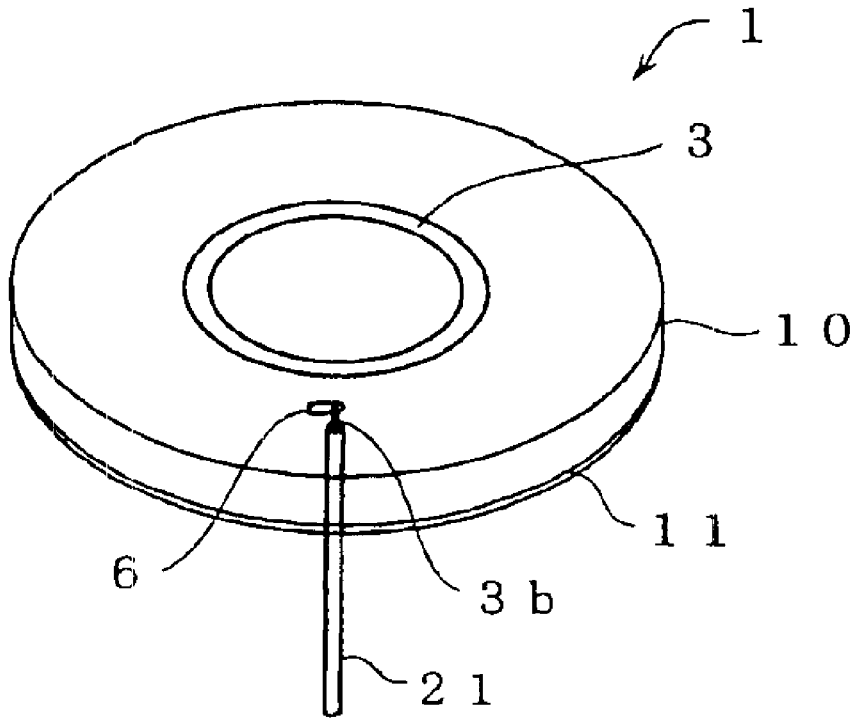
FIG. 8 is a perspective view of the feed structure for the second loop antenna according to the first embodiment of the present invention.
Figure 9:
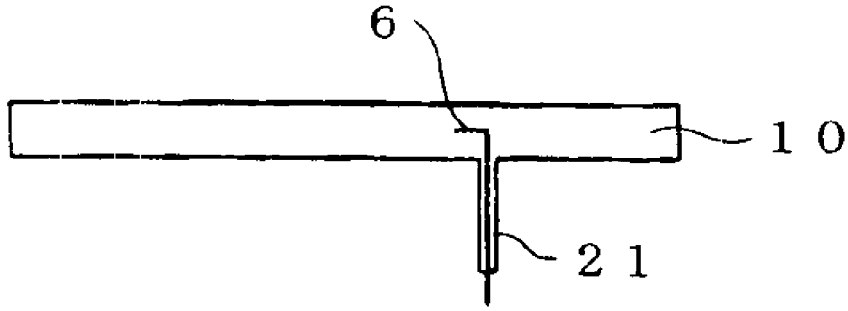
FIG. 9 is a side view of the feed structure for the second loop antenna according to the first embodiment of the present invention.

The constitution of the composite antenna according to the first embodiment of the present invention is shown in FIGS. 1 through 9, where FIG. 1 is a planar view of the composite antenna according to the present invention; FIG. 2 is a side view thereof; FIG. 3 is a rear view thereof; FIG. 4 is a cross-sectional view thereof along the line A—A; FIG. 5 is a cross-sectional view thereof along the line B—B; FIG. 6 is a perspective view of the feed structure for the first loop antenna; FIG. 7 is a side view of this constitution; FIG. 8 shows the feed structure for the second loop antenna; and FIG. 9 is a side view of this constitution.

The first composite antenna 1 shown in FIGS. 1 to 9 is a three-frequency composite antenna and is constituted to operate as a 1.5 GHz-band GPS antenna, a 2.5 GHz-band VICS radio wave beacon antenna, and a 5.8 GHz-band DSRC antenna for ETC or similar, for example.

A first loop antenna 2 is formed by a print pattern in the upper surface of a circular dielectric substrate 10 which constitutes this composite antenna 1. The first loop antenna 2 is constituted as a circularly polarized antenna as a result of being formed having a pair of perturbation elements 2*a* that lie opposite each other in an outward direction. Further, a second loop antenna 3 is formed by a print pattern within the first loop antenna 2 so as to lie substantially on the same axis as the first loop antenna 2. The second loop antenna 3 is a linearly polarized antenna. In addition, a recess 12 of a predetermined depth is formed substantially in the center of the dielectric substrate 10, and a square patch antenna 4 is formed in the bottom face of this recess 12. The patch antenna 4 is constituted as a circularly polarized antenna as a result of being formed with a top having a pair of opposing degeneracy separation elements 4*a*.

An earth pattern 11 is formed as shown in FIG. 3 over the whole of the underside of the dielectric substrate 10. The first loop antenna 2 is constituted to operate as a right-handed circularly polarized antenna as a result of electricity being supplied from an arc-shaped first feed pattern 5 which is disposed so as to be electromagnetically coupled to this first loop antenna. The feed point in this case is the first feed point 2*b* shown in FIG. 6. The first feed pattern 5 is disposed so as to be embedded in the dielectric substrate 10 and the structure of this pattern is shown in FIGS. 6 and 7. In FIGS. 6 and 7, the dielectric substrate 10 is shown as a transparent substrate. The core of a first feed line 20 which is a coaxial cable is connected to the first feed point 2*b* of the first feed pattern 5, and the shield of the first feed line 20 is connected to the earth pattern 11.

The second loop antenna 3 is constituted to operate as a linearly polarized antenna as a result of electricity being supplied from an arc-shaped second feed pattern 6 which is disposed so as to be electromagnetically coupled to this second loop antenna. The feed point in this case is the second feed point 3*b* shown in FIG. 8. The second feed pattern 6 is disposed so as to be embedded in the dielectric substrate 10 and the structure of this pattern is shown in FIGS. 8 and 9. In FIGS. 8 and 9, the dielectric substrate 10 is shown as a transparent substrate. The core of a second feed line 21 which is a coaxial cable is connected to the second feed point 3*b* of the second feed pattern 6, and the shield of the second feed line 21 is connected to the earth pattern 11. In addition, because the core of a third feed line 22 which is a coaxial cable is connected to a third feed point 4*b* of the patch antenna 4 shown in FIG. 1 so that electricity is supplied to the patch antenna 4, the patch antenna 4 operates as a right-handed circularly polarized antenna. Further, the shield of the third feed line 22 is connected to the earth pattern 11.

The recess 12 is provided in the upper surface of the dielectric substrate 10 in order to reduce the gap h2 between the patch antenna 4 and the earth pattern 11. The gap h2 is reduced in this way in order that the gap from the earth pattern of the patch antenna should be small in comparison with the loop antenna. The dielectric substrate 10 can be a Teflon substrate or another resin substrate and may be a substrate comprising a layer consisting substantially of air such as a honeycomb core substrate.

Figure 10:
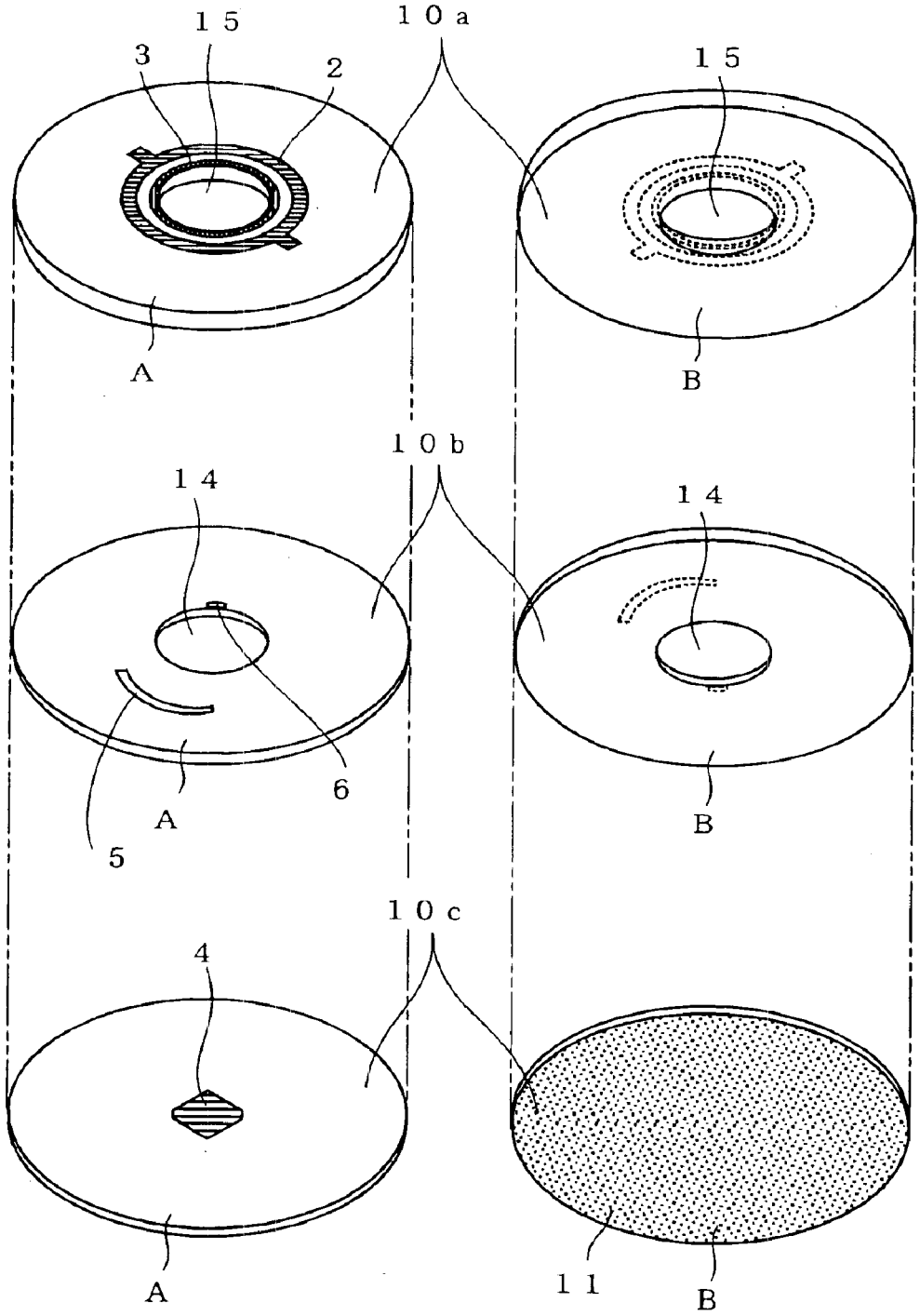
FIG. 10 is a development drawing that serves to illustrate the method for creating the composite antenna according to the first embodiment of the present invention.

An example of a method for creating the composite antenna 1 according to the first embodiment of the present invention is illustrated in FIG. 10.

According to this creation method, the composite antenna 1 is created by combining three dielectric substrates constituted by print substrates which are circular and of substantially equal diameter. A through-hole 15 for the formation of the recess 12 is formed substantially in the center of a first dielectric substrate 10*a* that lies uppermost, a pattern for the first loop antenna 2 being formed in the upper surface A of this substrate so as to surround the through-hole 15, and a pattern for the second loop antenna 3 being formed within the first loop antenna 2. A through-hole 14 for the formation of the recess 12 is formed substantially in the center of a second intermediate dielectric substrate 10*b*. Then, an arc-shaped first feed pattern 5 which is electromagnetically coupled to the first loop antenna 2, and a short arc-shaped second feed pattern 6 which is electromagnetically coupled to the second loop antenna 3 are formed in the upper surface A so as to lie substantially opposite each other.

In addition, a pattern for the patch antenna 4 is formed substantially in the center of the upper surface of a third dielectric substrate 10*c* that lies lowermost, and the earth pattern 11 is formed over the whole of the underside B of this substrate. The first composite antenna 1 according to the present invention can be created by aligning and combining these three dielectric substrates 10*a*, 10*b* and 10*c*. The patterns of the dielectric substrates 10*a*, 10*b* and 10*c* are formed by plating the substrates with copper foil, or an electrically conductive material, or the like.

The first composite antenna 1 according to the present invention comprises a first loop antenna 2 which is a right-handed circularly polarized loop antenna that operates in the GPS band and which is formed on the dielectric substrate 10. Because this antenna is a loop antenna, the space therein can be utilized. Therefore, in the case of the first composite antenna 1 according to the present invention, a second linearly polarized loop antenna 3 which operates in the VICS band is formed within the first loop antenna 2. Also, by utilizing the space in the second loop antenna 3, the square patch antenna 4 which operates in the ETC frequency band is disposed so as to be on substantially the same axis as the first loop antenna 2 and the second loop antenna 3. A small composite antenna which is capable of operating in three different frequency bands can accordingly be obtained, and the mount area for the composite antenna 1 can be reduced and handling thereof facilitated.

Figure 11:
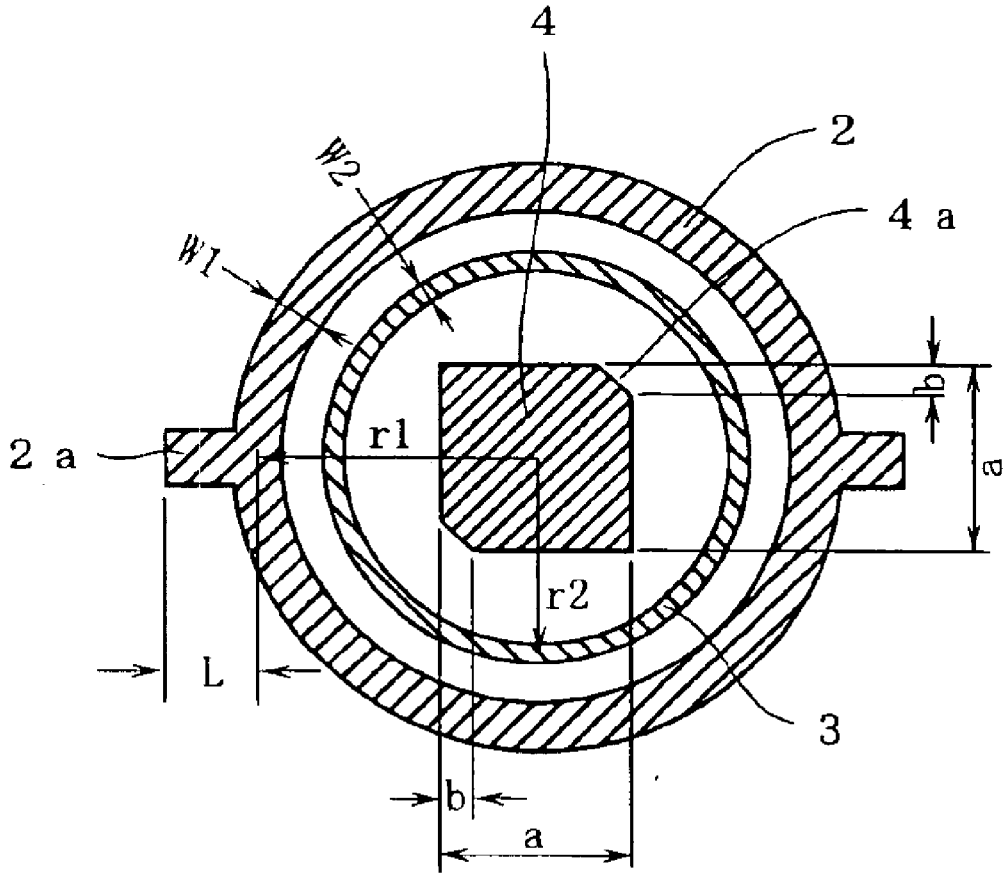
FIG. 11 serves to illustrate the dimensions of the parts of the composite antenna according to an embodiment of the present invention.

Here, a description will be provided with regard to the dimensions of the composite antenna 1 according to the first embodiment of the present invention which is shown in FIGS. 1 to 10, with reference to FIGS. 2, 4 and 11.

When the first loop antenna 2 is a GPS antenna and the wavelength for a frequency 1.57542 GHz in the 1.5 GHz band is $\lambda_1$, the second loop antenna 3 is a VICS radio wave beacon antenna and the wavelength for a frequency 2.4997 GHz in the 2.5 GHz band is $\lambda_2$, and the patch antenna 4 is an ETC antenna and the wavelength for a center frequency 5.82 GHz in the 5.8 GHz band is $\lambda_3$, the diameter R of the dielectric substrate 10 is equal to or more than approximately $0.52\lambda_1$, and the thickness h1 of the dielectric substrate 10 is approximately $0.07\lambda_1$. Further, the loop element radius r1 of the first loop antenna 2 is approximately $0.19\lambda_1$, the length L of the perturbation elements 2*a* is approximately $0.07\lambda_1$, and the loop element line width W1 of the first loop antenna 2 is approximately $0.03\lambda_1$. Further, the loop element radius r2 of the second loop antenna 3 is approximately $0.22\lambda_2$, and the loop element line width W2 of the second loop antenna 3 is approximately $0.04\lambda_2$. Further, when the thickness h1 of the dielectric substrate 10 is denoted by wavelength $\lambda_2$, this thickness is approximately $0.12\lambda_2$. In addition, the length of one of the vertical and lateral edges of the patch antenna 4 is approximately $0.5\lambda_3$, the length b of the degeneracy separation elements 4*a* is approximately $0.1\lambda_3$, and the gap between the patch antenna 4 and the earth pattern 11 is approximately $0.03\lambda_3$ to $0.13\lambda_3$.

Figure 12:
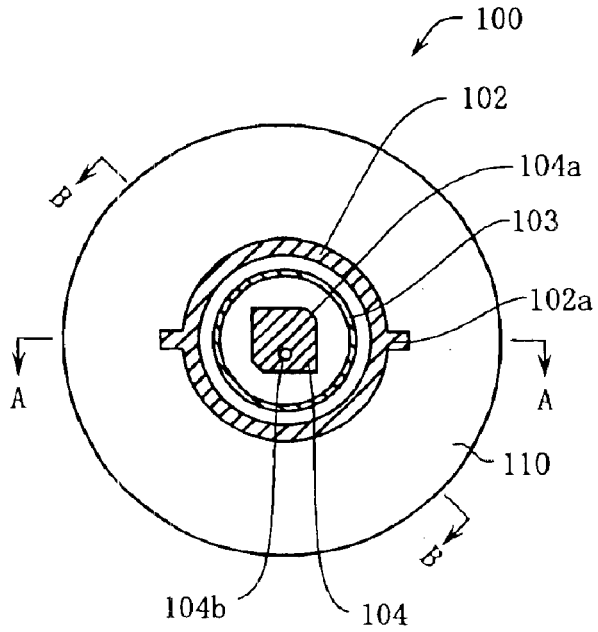
FIG. 12 is a planar view of the constitution of the composite antenna according to a second embodiment of the present invention.
Figure 13:
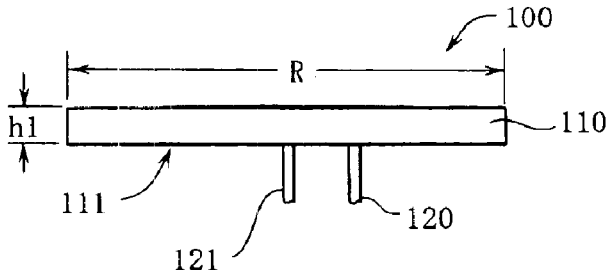
FIG. 13 is a side view of the constitution of the composite antenna according to the second embodiment of the present invention.
Figure 14:
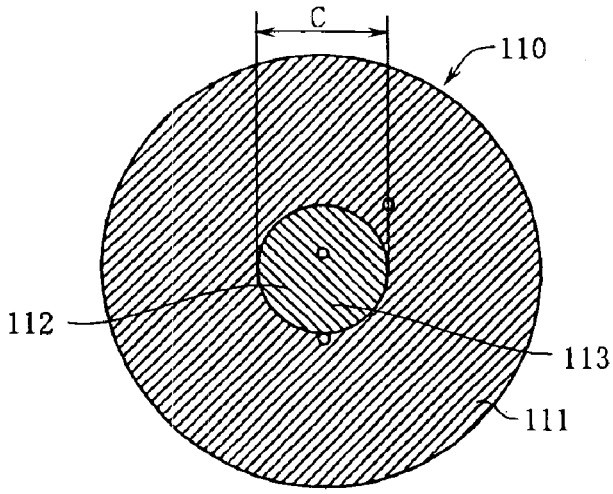
FIG. 14 is a rear view of the constitution of the composite antenna according to the second embodiment of the present invention.
Figure 15:
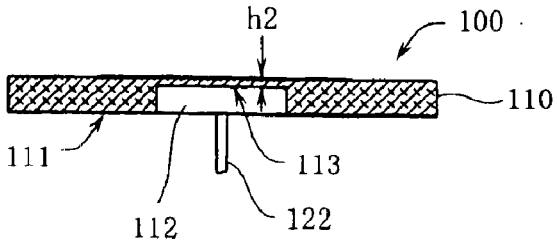
FIG. 15 is a cross-sectional view along the line A—A of the constitution of the composite antenna according to the second embodiment of the present invention.
Figure 16:
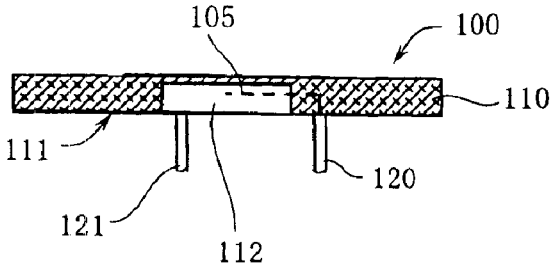
FIG. 16 is a cross-sectional view along the line B—B of the constitution of the composite antenna according to the second embodiment of the present invention.
Figure 17:
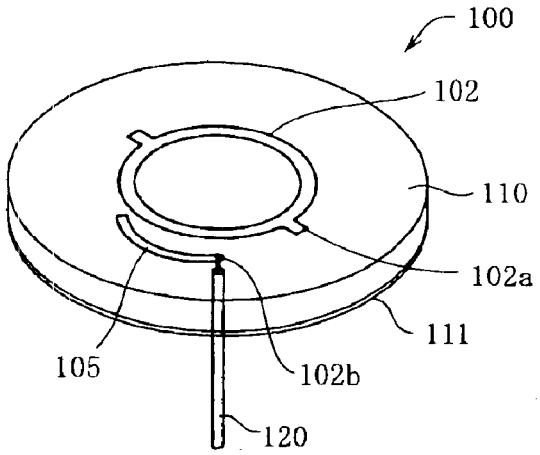
FIG. 17 is a perspective view of a feed structure for the first loop antenna according to the second embodiment of the present invention.
Figure 18:
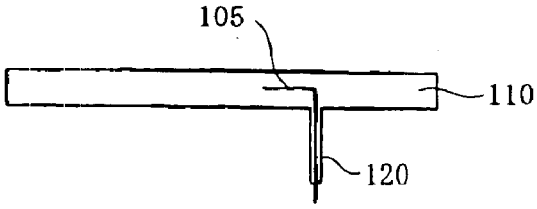
FIG. 18 is a side view of the feed structure for the first loop antenna according to the second embodiment of the present invention.
Figure 19:
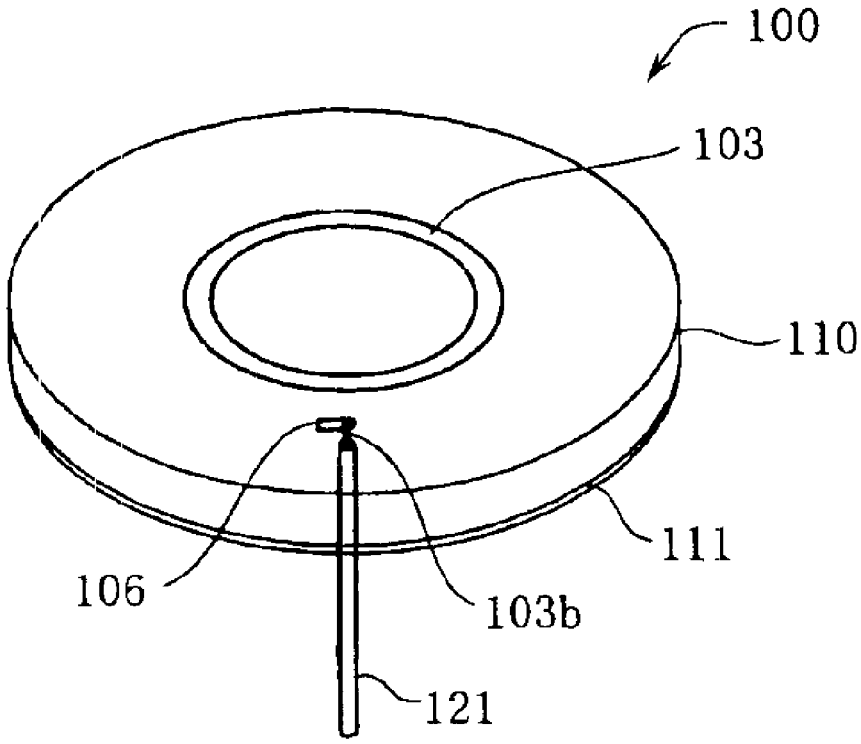
FIG. 19 is a perspective view of the feed structure for the second loop antenna according to the second embodiment of the present invention.
Figure 20:
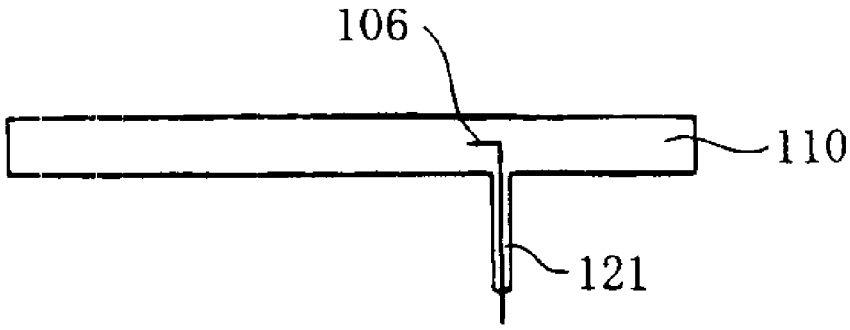
FIG. 20 is a side view of the feed structure for the second loop antenna according to the second embodiment of the present invention.

Next, the constitution of the composite antenna according to the second embodiment of the present invention is shown in FIGS. 12 to 20, where FIG. 12 is a planar view of a second composite antenna 100 according to the present invention; FIG. 13 is a side view thereof; FIG. 14 is a rear view thereof; FIG. 15 is a cross-sectional view along the line A—A; FIG. 16 is a cross-sectional view along the line B—B; FIG. 17 shows a feed structure for the first loop antenna; FIG. 18 is a side view showing the constitution thereof; FIG. 19 shows a feed structure for the second loop antenna; and FIG. 20 is a side view showing the constitution thereof.

The second composite antenna 100 shown in FIGS. 12 to 20 is a three-frequency composite antenna and is constituted to operate as a 1.5 GHz-band GPS antenna, a 2.5 GHz-band VICS radio wave beacon antenna, and a 5.8 GHz-band DSRC antenna for ETC or similar, for example. In these figures, a first loop antenna 102 is formed by a print pattern in the upper surface of a circular dielectric substrate 110 which constitutes the composite antenna 100. The first loop antenna 102 is constituted as a circularly polarized antenna as a result of being formed having a pair of perturbation elements 102*a* that lie opposite each other in an outward direction.

Also, the second loop antenna 103 is formed by a print pattern on the dielectric substrate 110 and within the first loop antenna 102 so as to lie on substantially the same axis as the first loop antenna 102. The second loop antenna 103 is a linearly polarized antenna. In addition, a patch antenna 104 is formed substantially in the center of the dielectric substrate 110 so as to lie on substantially the same axis as the first loop antenna 102 and the second loop antenna 103. This patch antenna 104 is a square patch antenna and is constituted as a circularly polarized antenna as a result of being formed with a top having a pair of opposing degeneracy separation elements 104*a*. In addition, a first earth pattern 111 is formed over the whole of the underside of the dielectric substrate 110, and a recess 112 of a predetermined depth is formed substantially in the center of this substrate. A second earth pattern 113 is formed in the bottom face of the recess 112.

In this composite antenna 100, the first loop antenna 102 is constituted to operate as a right-handed circularly polarized antenna as a result of electricity being supplied from an arc-shaped first feed pattern 105 which is disposed so as to be electromagnetically coupled to this first loop antenna. The feed point in this case is the first feed point 102*b* shown in FIG. 17. The first feed pattern 105 is disposed so as to be embedded in the dielectric substrate 110 and the structure of this pattern is shown in FIGS. 17 and 18. In FIGS. 17 and 18, the dielectric substrate 110 is shown as a transparent substrate. The core of a first feed line 120 which is a coaxial cable is connected to the first feed point 102*b* of the first feed pattern 105, and the shield of the first feed line 120 is connected to the first earth pattern 111. The second loop antenna 103 is constituted to operate as a linearly polarized antenna as a result of electricity being supplied from an arc-shaped second feed pattern 106 which is disposed so as to be electromagnetically coupled to this second loop antenna. The feed point in this case is the second feed point 103*b* shown in FIG. 19. The second feed pattern 106 is disposed so as to be embedded in the dielectric substrate 110 and the structure of this pattern is shown in FIGS. 19 and 20. In FIGS. 19 and 20, the dielectric substrate 110 is shown as a transparent substrate. The core of a second feed line 121 which is a coaxial cable is connected to the second feed point 103*b* of the second feed pattern 106, and the shield of the second feed line 121 is connected to the first earth pattern 111. In addition, because the core of a third feed line 122 which is a coaxial cable is connected to a third feed point 104*b* shown in FIG. 12 of the patch antenna 104 so that electricity is supplied to the patch antenna, the patch antenna 104 operates as a right-handed circularly polarized antenna. Further, the shield of the third feed line 122 is connected to the second earth pattern 113.

The recess 112 is provided in the underside of the dielectric substrate 110 in order to reduce the gap between the patch antenna 104 and the second earth pattern 113. The gap is reduced in this way in order that the gap from the earth pattern of the patch antenna should be small in comparison with the loop antenna. The dielectric substrate 110 can be a Teflon substrate or another resin substrate and may be a substrate comprising a layer consisting substantially of air such as a honeycomb core substrate. Further, by connecting the second earth pattern 113 and the first earth pattern 111 by forming an electrically conductive film on the circumferential wall face of the recess 112, leakage of electromagnetic waves from the circumferential wall face of the recess 112 may be prevented.

Figure 21:
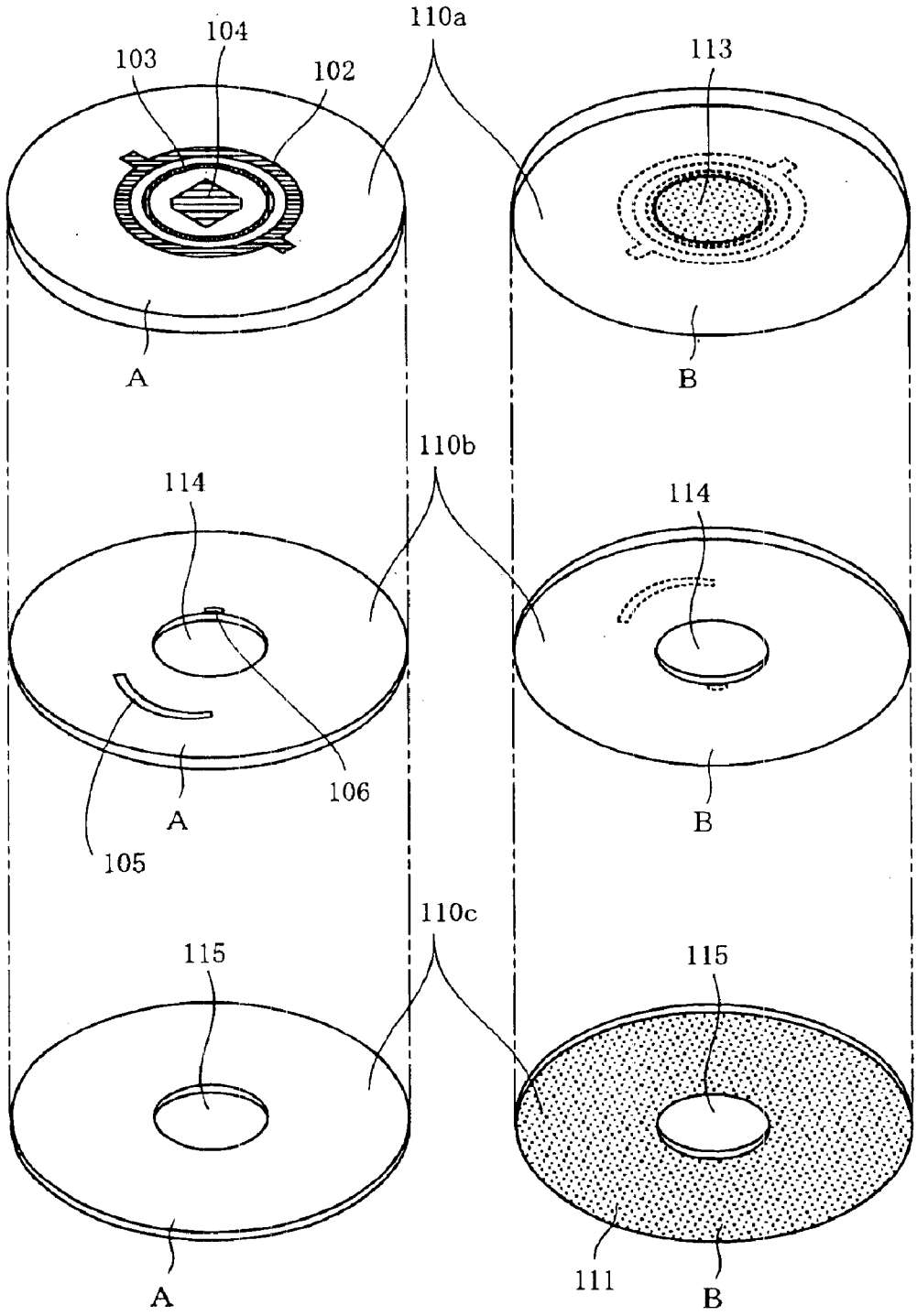
FIG. 21 is a development drawing that serves to illustrate the method for creating the composite antenna according to the second embodiment of the present invention.

Next, an example of a method for creating the composite antenna 100 according to the second embodiment of the present invention is illustrated in FIG. 21.

According to this creation method, the composite antenna 100 is created by combining three dielectric substrates constituted by print substrates which are circular and of substantially equal diameter. A pattern for the patch antenna 104 is formed substantially in the center of the upper surface A of a first dielectric substrate 110*a* that lies uppermost, a pattern for the second loop antenna 103 and a pattern for the first loop antenna 102 being formed sequentially on substantially the same axis as the patch antenna 104 so as to surround the patch antenna 104. A circular second earth pattern 113 that lies opposite the patch antenna 104 is also formed substantially in the center of the underside B of this substrate. A through-hole 114 for the formation of the recess 112 is formed substantially in the center of a second intermediate dielectric substrate 110*b*. Then, an arc-shaped first feed pattern 105 which is electromagnetically coupled to the first loop antenna 102, and a short arc-shaped second feed pattern 106 which is electromagnetically coupled to the second loop antenna 103 are formed in the upper surface A so as to lie substantially opposite each other. Further, an electrically conductive film may be formed on the circumferential side face of the through-hole 114. In addition, a through-hole 115 for the formation of the recess 112 is formed substantially in the center of a third dielectric substrate 110*c* that lies lowermost, a first earth pattern 111 being formed in the underside B of this substrate. An electrically conductive film may be formed on the circumferential side face of the through-hole 115. The second composite antenna 100 according to the present invention can be created by aligning and combining these three dielectric substrates 110*a*, 110*b* and 110*c*. The patterns of the dielectric substrates 110*a*, 110*b* and 110*c* are formed by plating the substrates with copper foil, or an electrically conductive material, or the like.

The second composite antenna 100 according to the present invention comprises a first loop antenna 102 which is a right-handed circularly polarized loop antenna that operates in the GPS band and which is formed on the dielectric substrate 110. Because this antenna is a loop antenna, the space therein can be utilized. Therefore, in the case of the second composite antenna 100 according to the present invention, a second linearly polarized loop antenna 103 which operates in the VICS band is disposed within the first loop antenna 102. Also, by utilizing the space in the second loop antenna 103, the square patch antenna 104 which operates in the ETC frequency band is disposed so as to be on substantially the same axis as the first loop antenna 102 and the second loop antenna 103. A small composite antenna which is capable of operating in three different frequency bands can accordingly be obtained, and the mount area for the composite antenna 100 can be reduced and handling thereof facilitated.

Here, a description will be provided with regard to the dimensions of the composite antenna 1 according to the first embodiment of the present invention which is shown in FIGS. 12 to 21, with reference to FIGS. 11, 13 and 15.

When the first loop antenna 102 is a GPS antenna and the wavelength for a frequency 1.57542 GHz in the 1.5 GHZ band is $\lambda_1$, the second loop antenna 103 is a VICS radio wave beacon antenna and the wavelength for a frequency 2.4997 GHz in the 2.5 GHz band is $\lambda_2$, and the patch antenna 104 is an ETC antenna and the wavelength for a center frequency 5.82 GHz in the 5.8 GHz band is $\lambda_3$, the diameter R of the dielectric substrate 110 is equal to or more than approximately $0.52\lambda_1$, and the thickness h1 of the dielectric substrate 110 is approximately $0.07\lambda_1$. Further, the loop element radius r1 of the first loop antenna 102 is approximately $0.19\lambda_1$, the length L of the perturbation elements 102*a* is approximately $0.07\lambda_1$, and the loop element line width W1 of the first loop antenna 102 is approximately $0.03\lambda_1$. Further, the loop element radius r2 of the second loop antenna 103 is approximately $0.22\lambda_2$, and the loop element line width W2 of the second loop antenna 103 is approximately $0.04\lambda_2$. Further, when the thickness h1 of the dielectric substrate 110 is denoted by wavelength $\lambda_2$, this thickness is approximately $0.12\lambda_2$. In addition, the length of one of the vertical and lateral edges of the patch antenna 104 is approximately $0.5\lambda_3$, the length b of the degeneracy separation elements 104*a* is approximately $0.1\lambda_3$, and the gap between the patch antenna 104 and the second earth pattern 113 is approximately $0.03\lambda_3$ to $0.13\lambda_3$.

Figure 22:
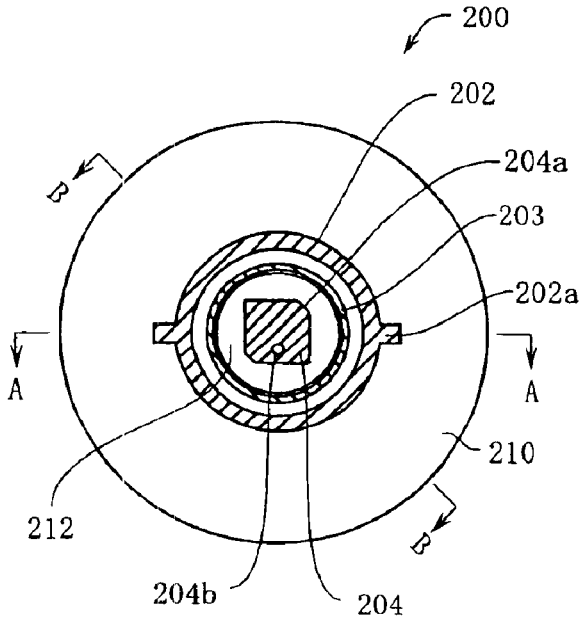
FIG. 22 is a planar view of the constitution of the composite antenna according to a third embodiment of the present invention.
Figure 23:
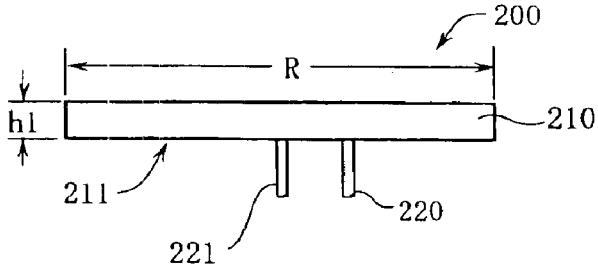
FIG. 23 is a side view of the constitution of the composite antenna according to the third embodiment of the present invention.
Figure 24:
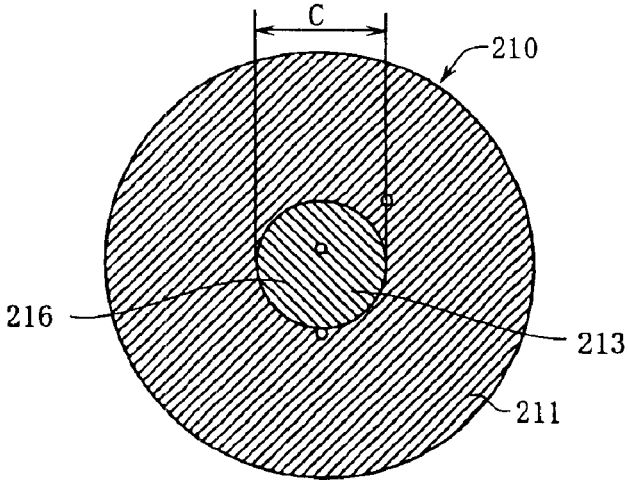
FIG. 24 is a rear view of the constitution of the composite antenna according to the third embodiment of the present invention.
Figure 25:
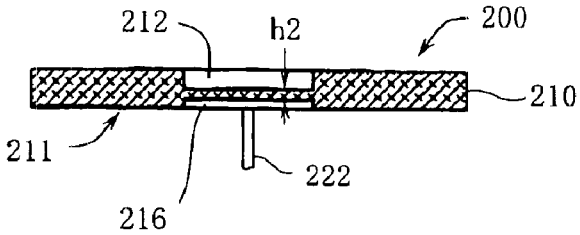
FIG. 25 is a cross-sectional view along the line A—A of the constitution of the composite antenna according to the third embodiment of the present invention.
Figure 26:
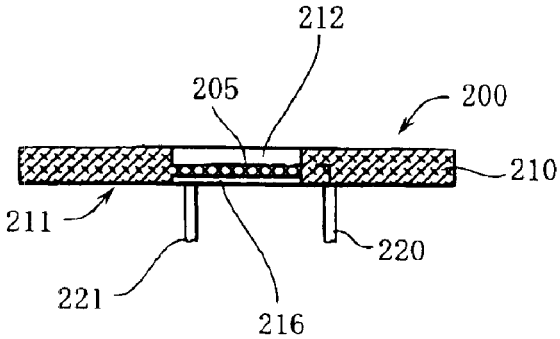
FIG. 26 is a cross-sectional view along the line B—B of the constitution of the composite antenna according to the third embodiment of the present invention.
Figure 27:
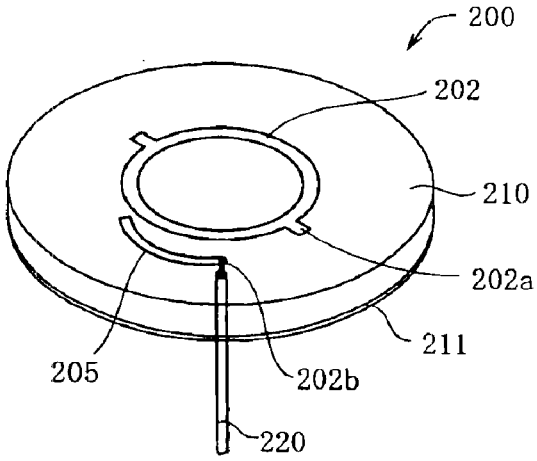
FIG. 27 is a perspective view of a feed structure for the first loop antenna according to the third embodiment of the present invention.
Figure 28:
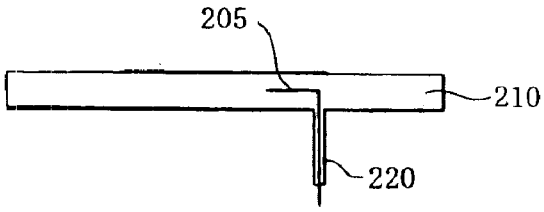
FIG. 28 is a side view of the feed structure for the first loop antenna according to the third embodiment of the present invention.
Figure 29:
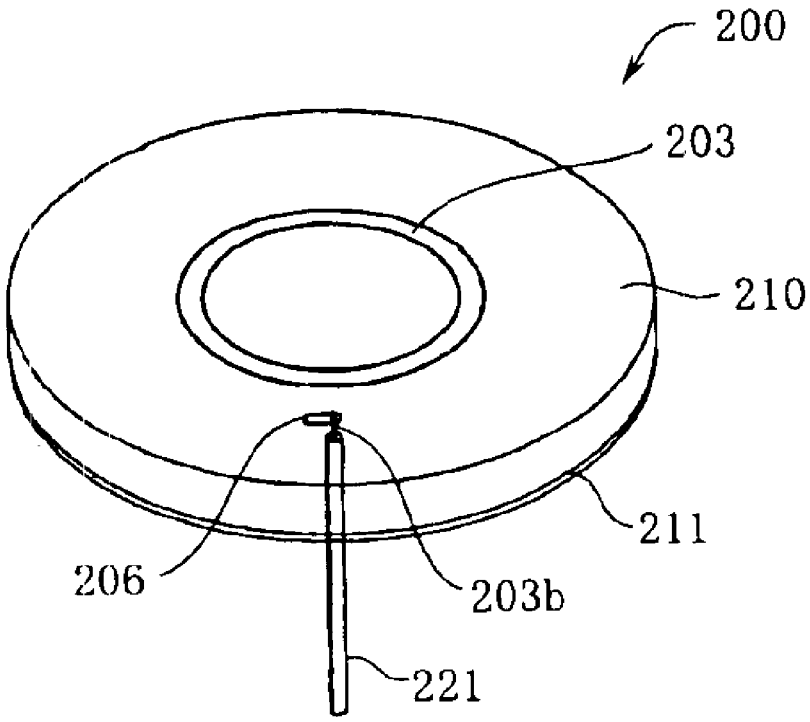
FIG. 29 is a perspective view of the feed structure for the second loop antenna according to the third embodiment of the present invention.

Next, the constitution of the composite antenna according to the third embodiment of the present invention is shown in FIGS. 22 to 30, where FIG. 22 is a planar view of a third composite antenna 200 according to the present invention; FIG. 23 is a side view thereof; FIG. 24 is a rear view thereof; FIG. 25 is a cross-sectional view along the line A—A; FIG. 26 is a cross-sectional view along the line B—B; FIG. 27 shows the feed structure for the first loop antenna; FIG. 28 is a side view showing the constitution thereof; FIG. 29 shows the feed structure for the second loop antenna; and FIG. 23 is a side view showing the constitution thereof.

The third composite antenna 200 shown in FIGS. 22 to 30 is a three-frequency composite antenna and is constituted to operate as a 1.5 GHz-band GPS antenna, a 2.5 GHz-band VICS radio wave beacon antenna, and a 5.8 GHz-band DSRC antenna for ETC or similar, for example. In these figures, a first loop antenna 202 is formed by a print pattern in the upper surface of a circular dielectric substrate 210 which constitutes the composite antenna 200. The first loop antenna 202 is constituted as a circularly polarized antenna as a result of being formed having a pair of perturbation elements 202*a* that lie opposite each other in an outward direction.

Also, the second loop antenna 203 is formed by a print pattern on the dielectric substrate 210 and within the first loop antenna 202 so as to lie on substantially the same axis as the first loop antenna 202. The second loop antenna 203 is a linearly polarized antenna. In addition, an upper recess 212 of a predetermined depth is formed substantially in the center of the upper surface of the dielectric substrate 210, and a patch antenna 204 is formed by a print pattern so as to be situated substantially in the center of the bottom face of an upper recess 212. This patch antenna 204 is a square patch antenna and is constituted as a circularly polarized antenna as a result of being formed with a top having a pair of opposing degeneracy separation elements 204*a*. In addition, a first earth pattern 211 is formed over the whole of the underside of the dielectric substrate 210, and a lower recess 216 of a predetermined depth is formed substantially in the center of the underside of the dielectric substrate 210. A circular second earth pattern 213 is formed in the bottom face of the lower recess 216.

Figure 30:
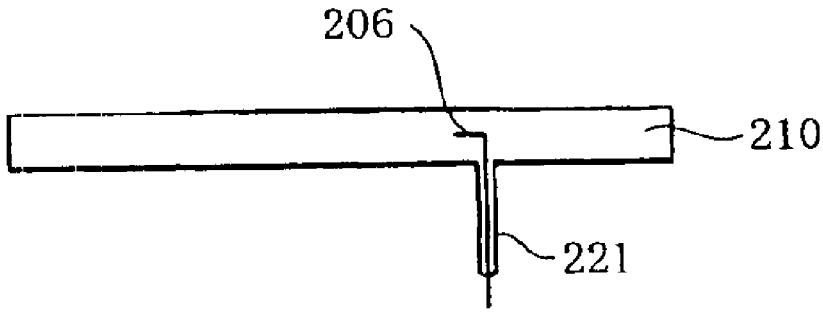
FIG. 30 is a side view of the feed structure for the second loop antenna according to the third embodiment of the present invention.

In this composite antenna 200, the first loop antenna 202 is constituted to operate as a right-handed circularly polarized antenna as a result of electricity being supplied from an arc-shaped first feed pattern 205 which is disposed so as to be electromagnetically coupled to this first loop antenna. The feed point in this case is the first feed point 202*b* shown in FIG. 27. The first feed pattern 205 is disposed so as to be embedded in the dielectric substrate 210 and the structure of this pattern is shown in FIGS. 27 and 28. In FIGS. 27 and 28, the dielectric substrate 210 is shown as a transparent substrate. The core of a first feed line 220 which is a coaxial cable is connected to the first feed point 202*b* of the first feed pattern 205, and the shield of the first feed line 220 is connected to the first earth pattern 211. The second loop antenna 203 is constituted to operate as a linearly polarized antenna as a result of electricity being supplied from an arc-shaped second feed pattern 206 which is disposed so as to be electromagnetically coupled to this second loop antenna. The feed point in this case is the second feed point 203*b* shown in FIG. 29. The second feed pattern 206 is disposed so as to be embedded in the dielectric substrate 210 and the structure of this pattern is shown in FIGS. 29 and 30. In FIGS. 29 and 30, the dielectric substrate 210 is shown as a transparent substrate. The core of a second feed line 221 which is a coaxial cable is connected to the second feed point 203*b* of the second feed pattern 206, and the shield of the second feed line 221 is connected to the first earth pattern 211. In addition, because the core of a third feed line 222 which is a coaxial cable is connected to a third feed point 204*b* shown in FIG. 22 of the patch antenna 204 so that electricity is supplied to the patch antenna, the patch antenna 204 operates as a right-handed circularly polarized antenna. Further, the shield of the third feed line 222 is connected to the second earth pattern 213.

The upper recess. 212 is provided in the upper surface of the dielectric substrate 210 and the lower recess 216 is provided in the underside of this substrate in order to reduce the gap between the patch antenna 204 and the second earth pattern 213. The gap is reduced in this way in order that the gap from the earth pattern of the patch antenna should be small in comparison with the loop antenna. The dielectric substrate 210 can be a Teflon substrate or another resin substrate and may be a substrate comprising a layer consisting substantially of air such as a honeycomb core substrate. Further, by connecting the second earth pattern 213 and the first earth pattern 211 by forming an electrically conductive film on the circumferential wall face of the lower recess 216, leakage of electromagnetic waves from the circumferential wall face of the lower recess 216 may be prevented.

Figure 31:
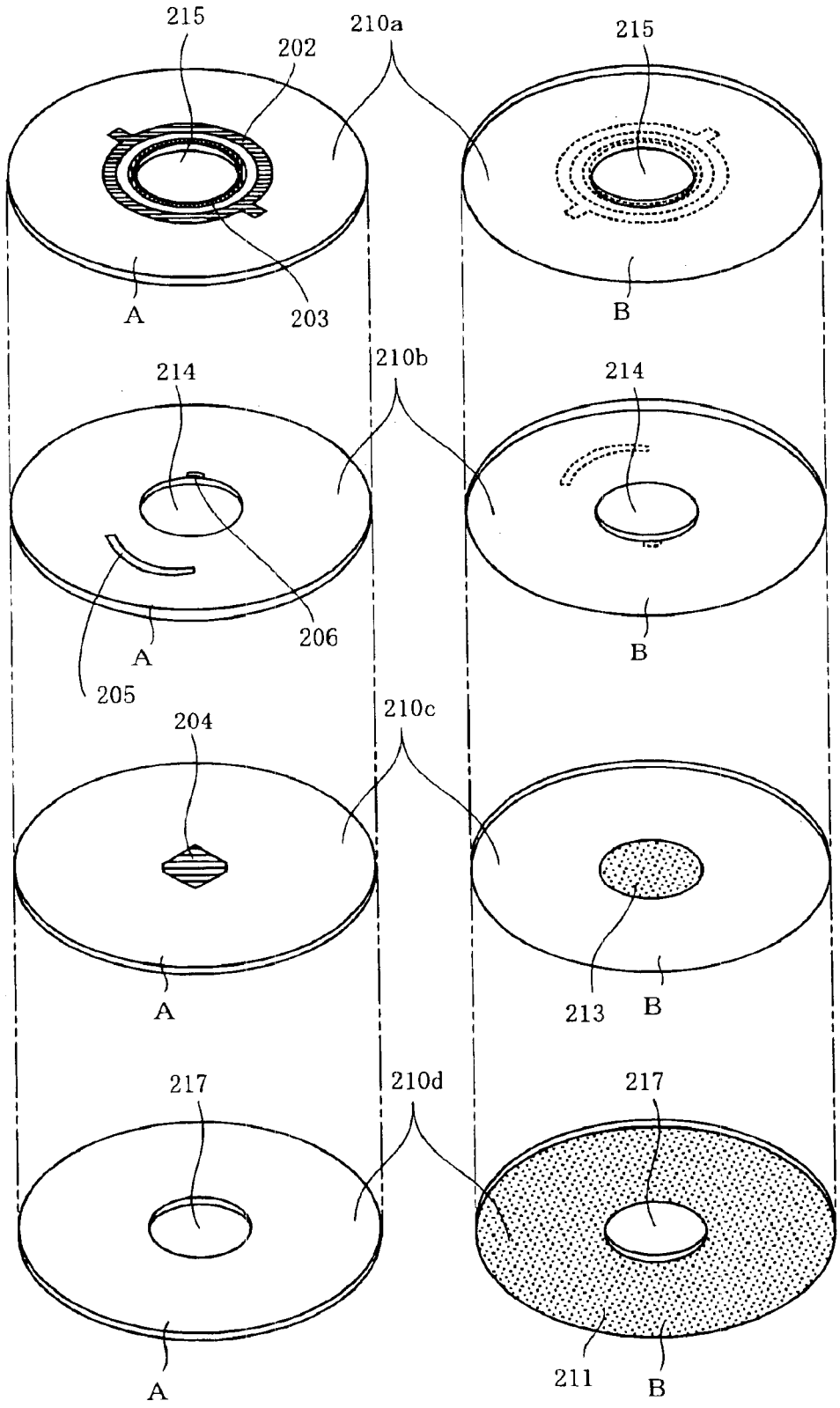
FIG. 31 is a development drawing that serves to illustrate the method for creating the composite antenna according to the third embodiment of the present invention.

An example of a method for creating the composite antenna 200 according to the third embodiment of the present invention is illustrated in FIG. 31.

According to this creation method, the composite antenna 200 is created by combining four dielectric substrates constituted by print substrates which are circular and of substantially equal diameter. A through-hole 215 for the formation of the upper recess 212 is formed substantially in the center of a first dielectric substrate 210*a* that lies uppermost, a pattern for the first loop antenna 202 being formed in the upper surface A of this substrate so as to surround the through-hole 215, and a pattern for the second loop antenna 203 being formed within the first loop antenna 202. A through-hole 214 for the formation of the upper recess 212 is formed substantially in the center of a second intermediate dielectric substrate 210*b*, and an arc-shaped first feed pattern 205 which is electromagnetically coupled to the first loop antenna 202, and a short arc-shaped second feed pattern 206 which is electromagnetically coupled to the second loop antenna 203 are formed in the upper surface A so as to lie substantially opposite each other.

In addition, a pattern for the patch antenna 204 is formed substantially in the center of the upper surface of a third dielectric substrate 210*c* that lies beneath the second dielectric substrate 210*b*, and the circular second earth pattern 213 that lies opposite the patch antenna 204 is formed substantially in the center of the underside B of this substrate. In addition, a through-hole 217 for the formation of the lower recess 216 is formed substantially in the center of a fourth dielectric substrate 210*d* that lies lowermost, the first earth pattern 211 being formed over the whole of the underside B of this substrate. An electrically conductive film may be formed on the circumferential side face of the through-hole 217. The third composite antenna 200 according to the present invention can be created by aligning and combining these four dielectric substrates 210*a*, 210*b*, 210*c*, and 210*d*. The patterns of the dielectric substrates 210*a*, 210*b*, 210*c*, and 210*d* are formed by plating the substrates with copper foil, or an electrically conductive material, or the like.

The third composite antenna 200 according to the present invention comprises a first loop antenna 202 which is a right-handed circularly polarized loop antenna that operates in the GPS band and which is formed on the dielectric substrate 210. Because this antenna is a loop antenna, the space therein can be utilized. Therefore, in the case of the third composite antenna 200 according to the present invention, a second linearly polarized loop antenna 203 which operates in the VICS band is formed within the first loop antenna 202. Also, by utilizing the space in the second loop antenna 203, the square patch antenna 204 which operates in the ETC frequency band is disposed so as to be on substantially the same axis as the first loop antenna 202 and the second loop antenna 203. A small composite antenna which is capable of operating in three different frequency bands can accordingly be obtained, and the mount area for the composite antenna 200 can be reduced and handling thereof facilitated.

Here, a description will be provided with regard to the dimensions of the composite antenna 200 according to the third embodiment of the present invention which is shown in FIGS. 22 to 31, with reference to FIGS. 11, 23 and 25.

When the first loop antenna 202 is a GPS antenna and the wavelength for a frequency 1.57542 GHz in the 1.5 GHz band is $\lambda_1$, the second loop antenna 203 is a VICS radio wave beacon antenna and the wavelength for a frequency 2.4997 GHz in the 2.5 GHz band is $\lambda_2$, and the patch antenna 204 is an ETC antenna and the wavelength for a center frequency 5.82 GHz in the 5.8 GHz band is $\lambda_3$, the diameter R of the dielectric substrate 210 is equal to or more than approximately $0.52\lambda_1$, and the thickness h1 of the dielectric substrate 210 is approximately $0.07\lambda_1$. Further, the loop element radius r1 of the first loop antenna 202 is approximately $0.19\lambda_1$, the length L of the perturbation elements 202*a* is approximately $0.07\lambda_1$, and the loop element line width W1 of the first loop antenna 202 is approximately $0.03\lambda_1$. Further, the loop element radius r2 of the second loop antenna 203 is approximately $0.22\lambda_2$, and the loop element line width W2 of the second loop antenna 203 is approximately $0.04\lambda_2$. Further, when the thickness h1 of the dielectric substrate 210 is denoted by wavelength $\lambda_2$, this thickness is approximately $0.12\lambda_2$. In addition, the length of one of the vertical and lateral edges of the patch antenna 204 is approximately $0.5\lambda_3$, the length b of the degeneracy separation elements 204*a* is approximately $0.1\lambda_3$, and the gap between the patch antenna 204 and the second earth pattern 213 is approximately $0.03\lambda_3$ to $0.13\lambda_3$.

Next, the antenna characteristics of the composite antenna 1 according to the first embodiment are shown in FIGS. 32 to 43, the corresponding dimensions of the parts of the composite antenna 1 having the values provided above.

Figure 32:
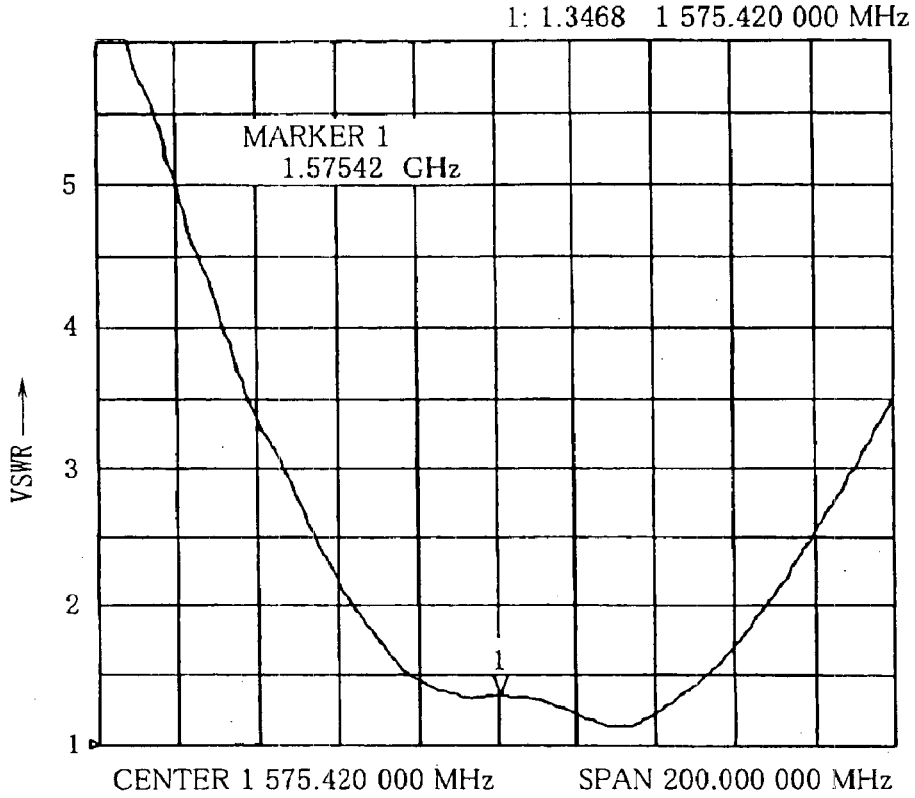
FIG. 32 is a graph showing the VSWR characteristic in the GPS band of the composite antenna according to the first embodiment of the present invention.
Figure 33:
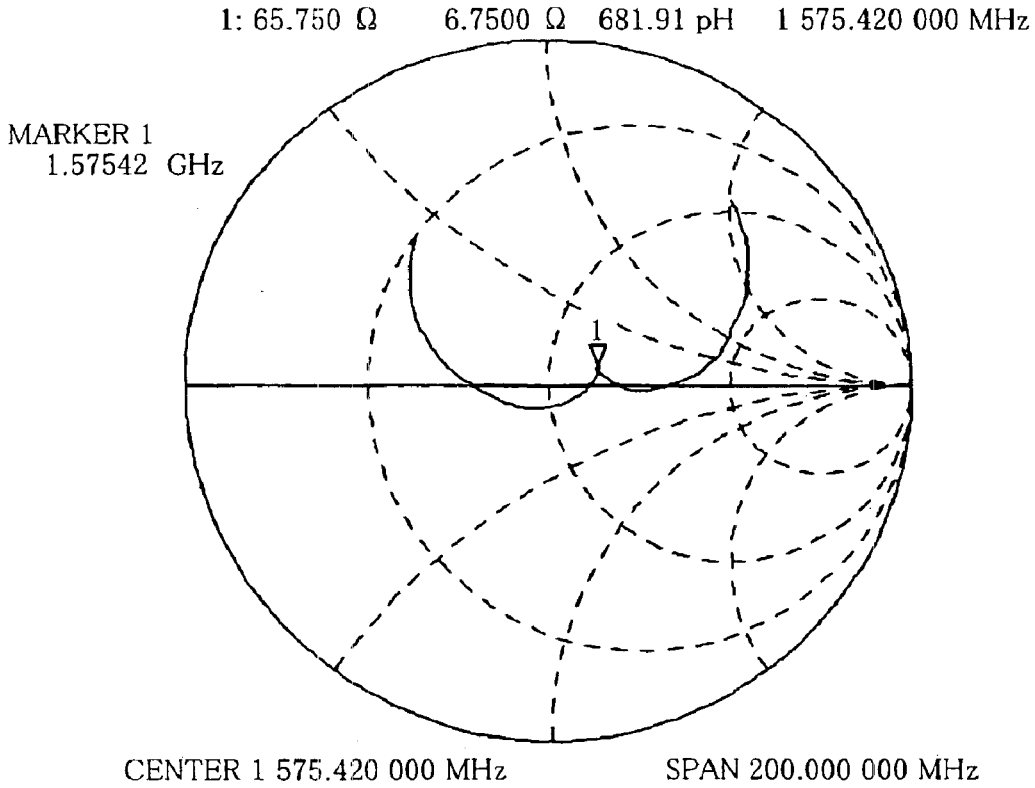
FIG. 33 is a Smith chart showing the impedance characteristic in the GPS band of the composite antenna according to the first embodiment of the present invention.
Figure 34:
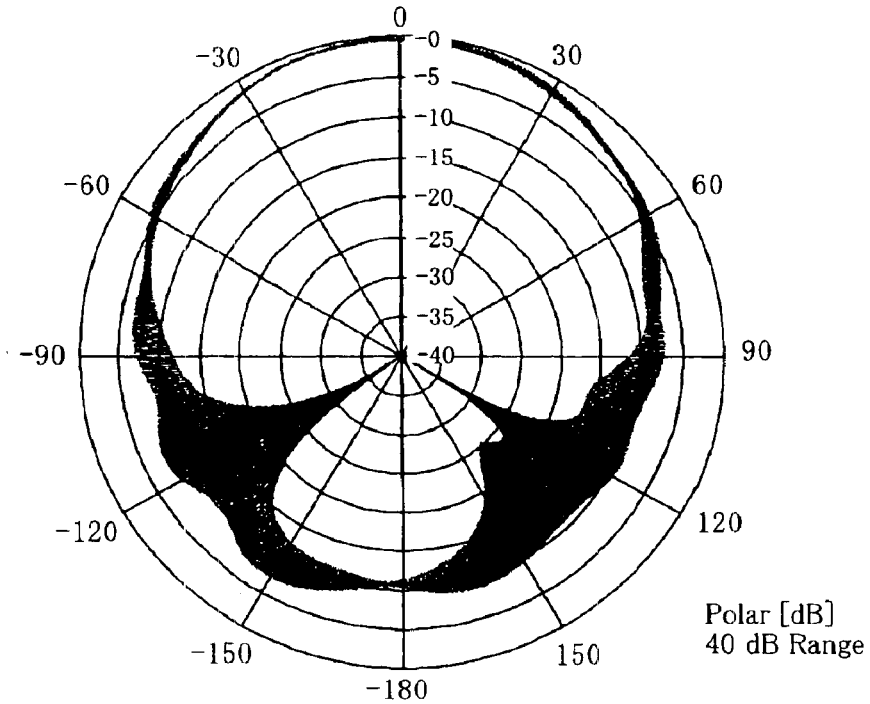
FIG. 34 shows the axial ratio characteristic in the plane $\phi=0°$ in the GPS band of the composite antenna according to the first embodiment of the present invention.
Figure 35:
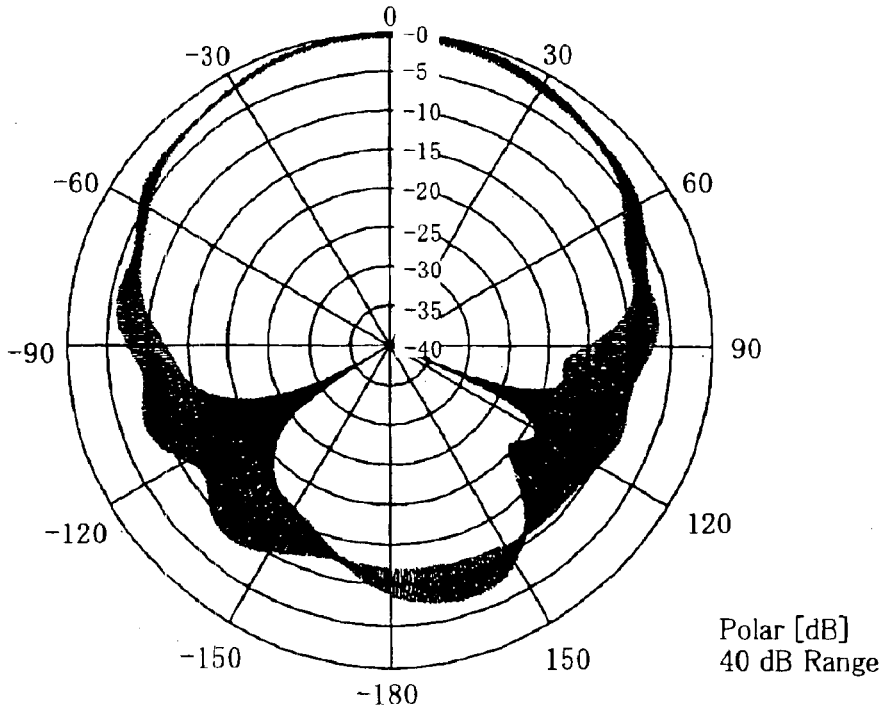
FIG. 35 shows the axial ratio characteristic in the plane $\phi=90°$ in the GPS band of the composite antenna according to the first embodiment of the present invention.

FIG. 32 shows the VSWR characteristic in the GPS band of the first loop antenna 2. Referring to FIG. 32, a favorable VSWR of approximately 1.35 is obtained at the 1.57542 GHz employed in the GPS band. Further, FIG. 33 is a Smith chart showing the impedance characteristic in the GPS band of the first loop antenna 2. Referring now to FIG. 33, favorable normalized impedance which is close to 1 is obtained at the 1.57542 GHz employed in the GPS band. FIG. 34 shows the axial ratio characteristic in the plane ø=0° (the direction passing from the center through the middle of the perturbation elements 2*a*) in the GPS band of the first loop antenna 2. Referring now to FIG. 34, a favorable axial ratio is obtained in the range upward of approximately −90° to 90°. Further, FIG. 35 shows the axial ratio characteristic in the plane ø=90° in the GPS band of the first loop antenna 2. Referring now to FIG. 35, a favorable axial ratio is obtained in the range upward of approximately −90° to 80°.

Figure 36:
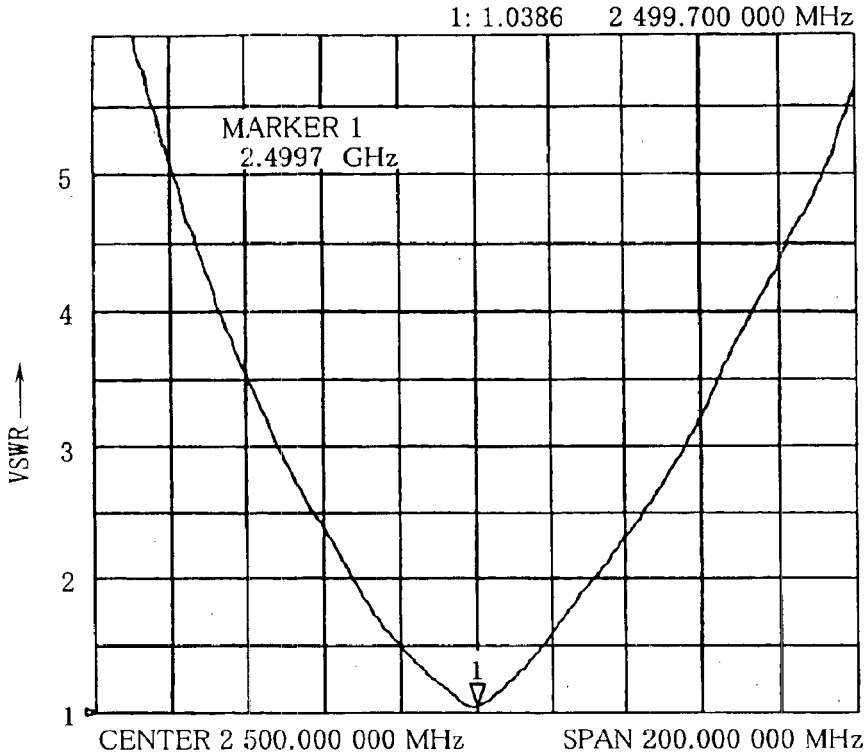
FIG. 36 is a graph showing the VSWR characteristic in the VICS radio wave beacon frequency band of the composite antenna according to the first embodiment of the present invention.
Figure 37:
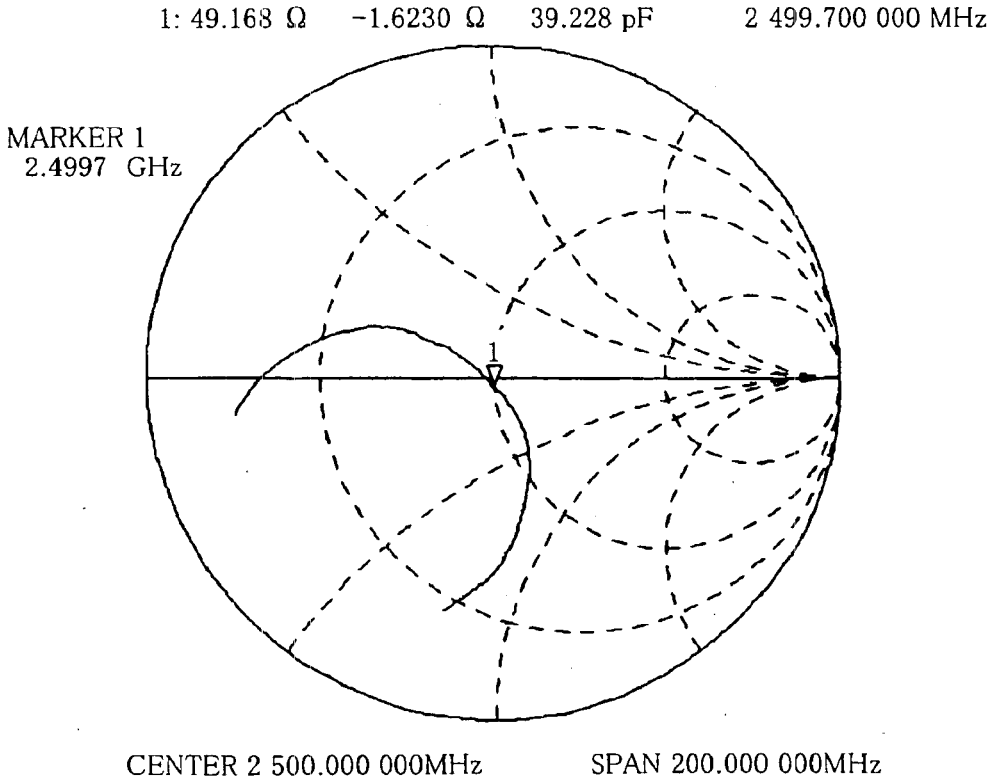
FIG. 37 is a Smith chart showing the impedance characteristic in the VICS radio wave beacon frequency band of the composite antenna according to the first embodiment of the present invention.
Figure 38:
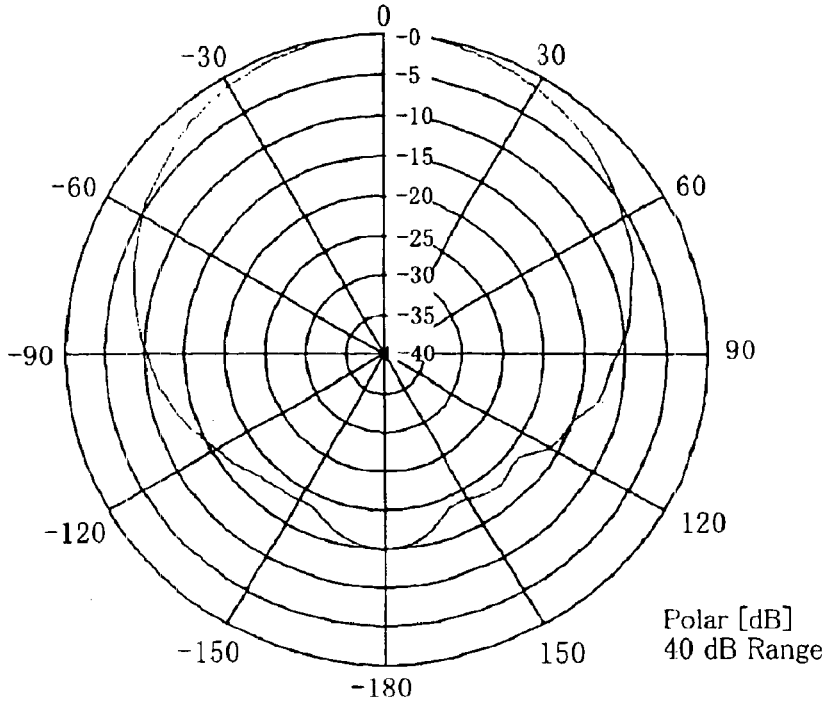
FIG. 38 shows the vertical polarization directional characteristic in the plane $\phi=0°$ in the VICS radio wave beacon frequency band of the composite antenna according to the first embodiment of the present invention.

In addition, FIG. 36 shows the VSWR characteristic in the VICS (radio wave beacon) frequency band of the second loop antenna 3. Referring now to FIG. 36, a favorable VSWR of approximately 1.04 is obtained at the 2.4997 GHz employed by the VICS radio wave beacon indicated by the marker 1. Furthermore, FIG. 37 is a Smith chart showing the impedance characteristic in the VICS (radio wave beacon) frequency band of the second loop antenna 3. Referring now to FIG. 37, favorable normalized impedance of approximately 1 is obtained at the 2.4997 GHz employed by the VICS radio wave beacon indicated by the marker 1. In addition, FIG. 38 shows the vertical polarization directional characteristic in the plane ø=0° at the 2.4997 GHz employed by the VICS radio wave beacon of the second loop antenna 3. Referring now to FIG. 38, a favorable directional characteristic within −10 dB is obtained in the range upward of approximately −90° to 90°. Furthermore, FIG. 39 shows the horizontal polarization directional characteristic in the plane ø=90° at the 2.4997 GHz employed by the VICS radio wave beacon of the second loop antenna 3.

Figure 39:
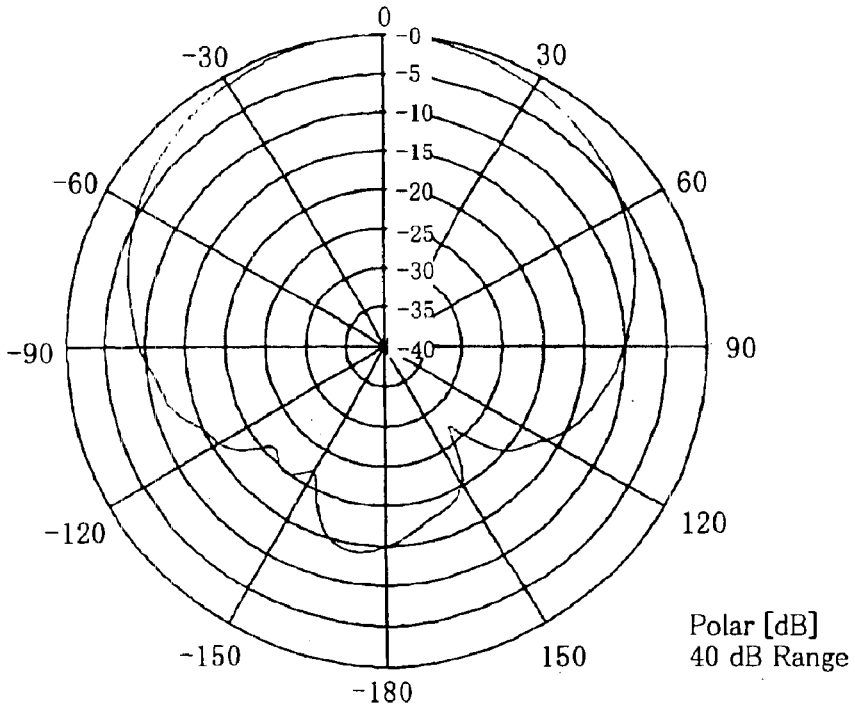
FIG. 39 shows the vertical polarization directional characteristic in the plane $\phi=90°$ in the VICS radio wave beacon frequency band of the composite antenna according to the first embodiment of the present invention.

Referring now to FIG. 39, a favorable directional characteristic within −10 dB is obtained in the range upward of approximately −90° to 90°.

Figure 40:
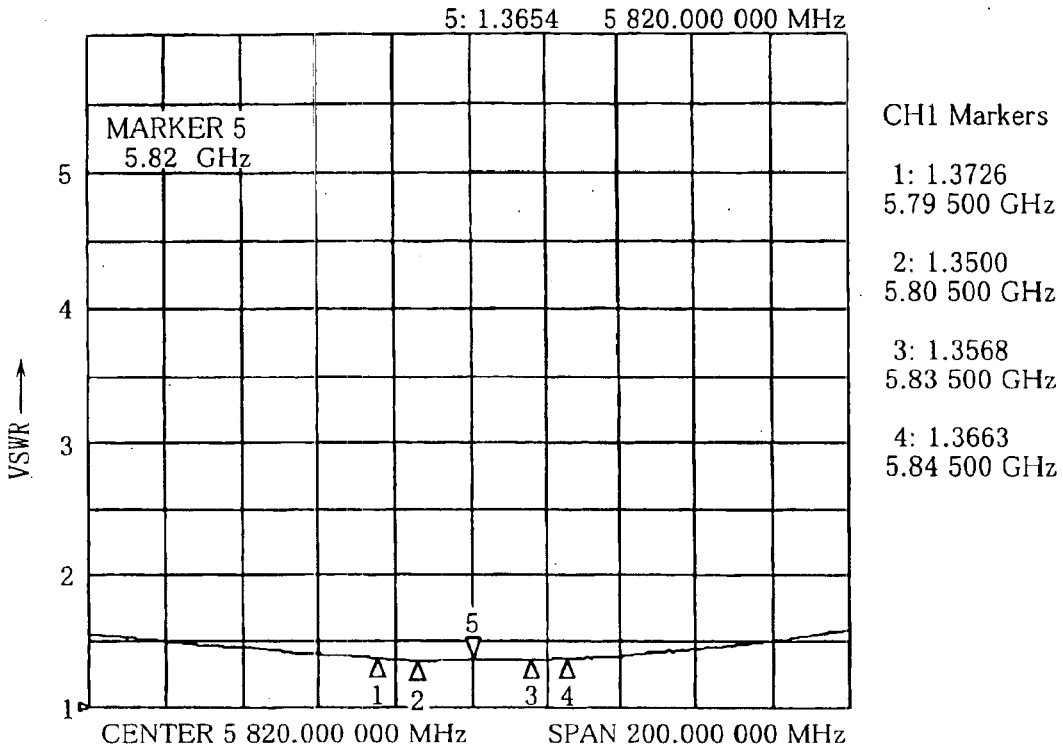
FIG. 40 is a graph showing the VSWR characteristic in the ETC band of the composite antenna according to the first embodiment of the present invention.
Figure 41:
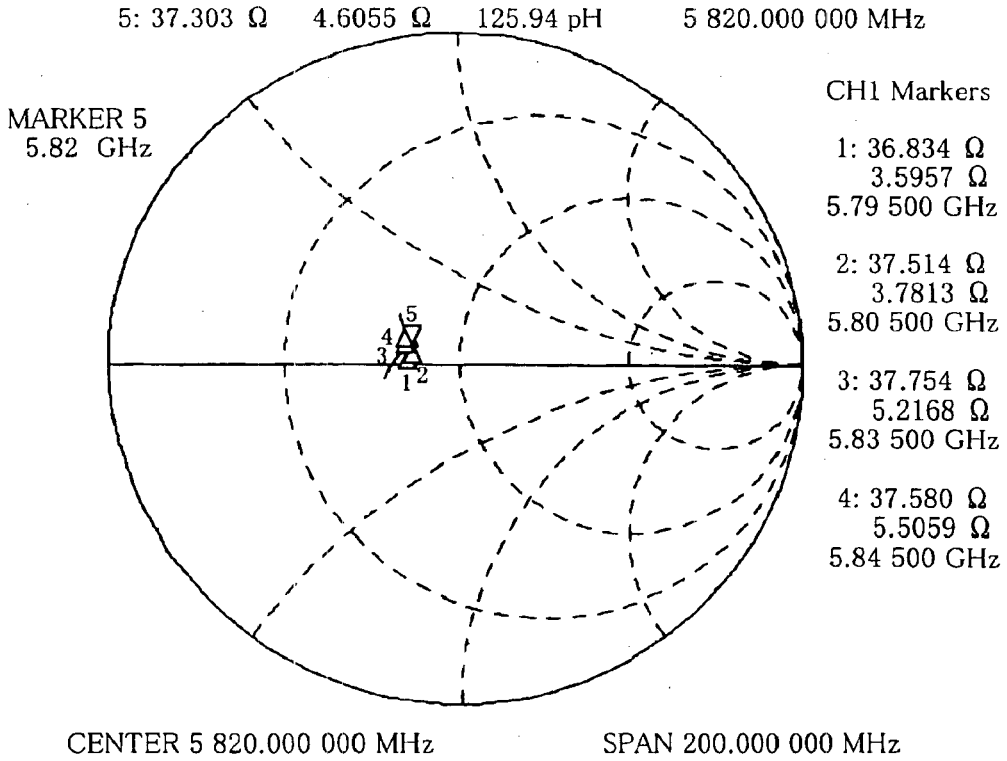
FIG. 41 is Smith chart showing the impedance characteristic in the ETC band of the composite antenna according to the first embodiment of the present invention.
Figure 42:
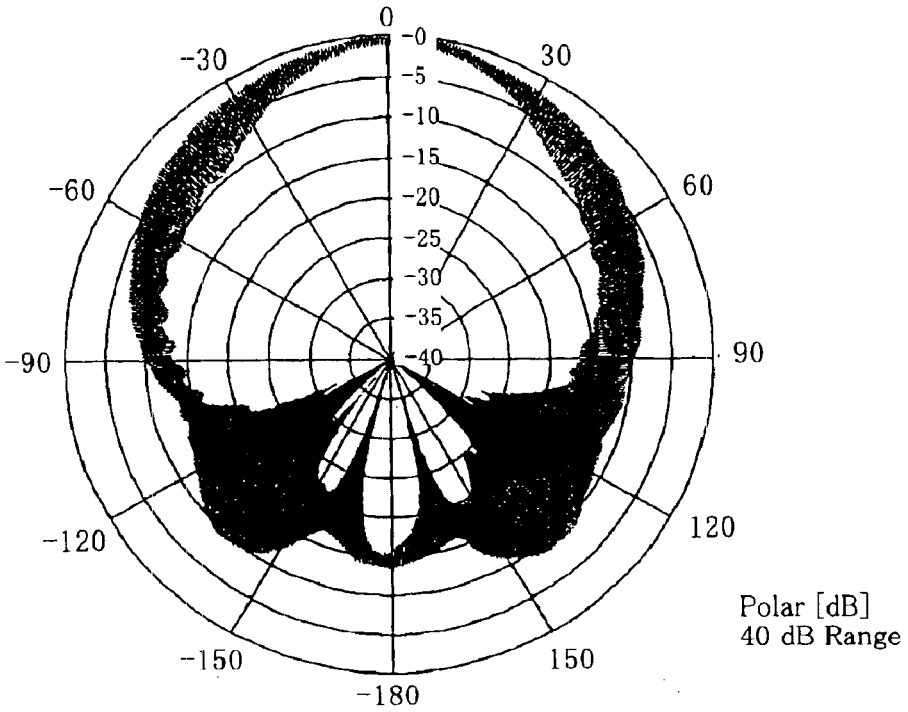
FIG. 42 shows the axial ratio characteristic in the plane ø=0° in the ETC band of the composite antenna according to the first embodiment of the present invention.
Figure 43:
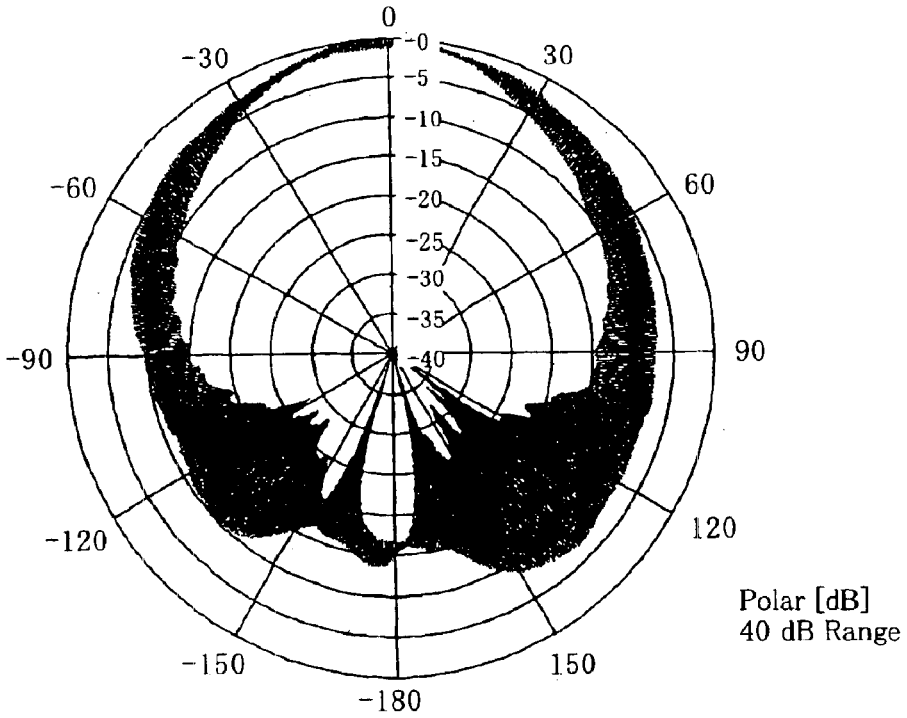
FIG. 43 shows the axial ratio characteristic in the plane ø=90° in the ETC band of the composite antenna according to the first embodiment of the present invention.

In addition, FIG. 40 shows the VSWR characteristic in the ETC frequency band of the patch antenna 4. Referring now to FIG. 40, a favorable VSWR of no more than approximately 1.37 is obtained in the ETC frequency band indicated by the markers 1 through 4. Furthermore, FIG. 41 is a Smith chart showing the impedance characteristic in the ETC frequency band of the patch antenna 4. Referring now to FIG. 41, favorable normalized impedance that is close to 1 is obtained in the ETC frequency band indicated by the markers 1 through 4. Further, FIG. 42 shows the axial ratio characteristic in the plane ø=0° at the ETC center frequency of the patch antenna 4. Referring now to FIG. 42, a favorable axial ratio is obtained in the range upward of approximately −90° to 90°. Further, FIG. 43 shows the axial ratio characteristic in the plane ø=90° at the ETC center frequency of the patch antenna 4. Referring now to FIG. 43, a favorable axial ratio is obtained in the range upward of approximately −90° to 80°.

Next, modified examples of the above-described first to third composite antennae 1 to 200 according to the present invention are shown in FIGS. (44*a*), (44*b*) and (44*c*). Further, FIGS. (44*a*), (44*b*) and (44*c*) are planar views of the modified examples of the composite antennae according to the present invention.

The modified example of a composite antenna shown in FIG. (44*a*) is a three-frequency composite antenna 400 which is constituted to operate as a 1.5 GHz-band GPS antenna, a 2.5 GHz-band VICS radio wave beacon antenna, and a 5.8 GHz-band DSRC antenna for ETC or similar, for example. A GPS first loop antenna 402 is formed by a print pattern in the upper surface of a dielectric substrate 410 which constitutes the composite antenna 400. The first loop antenna 402 is constituted as a circularly polarized loop antenna as a result of being formed having a pair of perturbation elements 402*a* that lie opposite each other in an outward direction. A VICS second loop antenna 403 is formed by a print pattern within the first loop antenna 402. The second loop antenna 403 is a linearly polarized antenna. A right-handed polarization spiral antenna 404 which operates in the DSRC frequency band is formed by a print pattern substantially in the center of the second loop antenna 403. Further, an earth pattern is formed over the whole of the underside of the dielectric substrate 410. In the case of the composite antenna 400, because the second loop antenna 403 serving as a VICS radio wave beacon, and the spiral antenna 404 which operates in the ETC frequency band are disposed on substantially the same axis within the first loop antenna 402 which operates in the GPS band and is formed on the dielectric substrate 410, a small composite antenna which is capable of operating in three different frequency bands can accordingly be obtained.

Figure 44A:
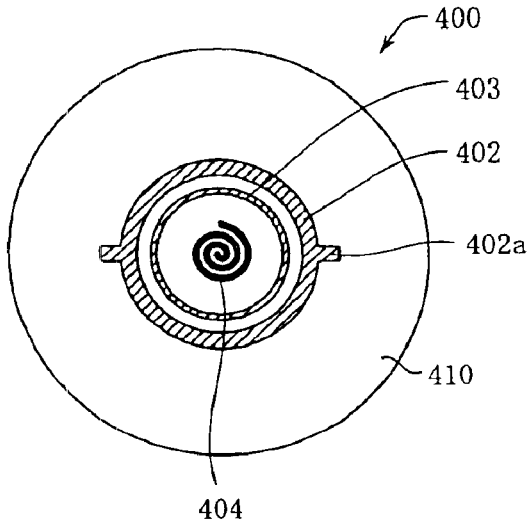
FIG. 44(*a*) is a planar view showing the constitution of a modified example of the composite antenna according to the first embodiment of the present invention.
Figure 44B:
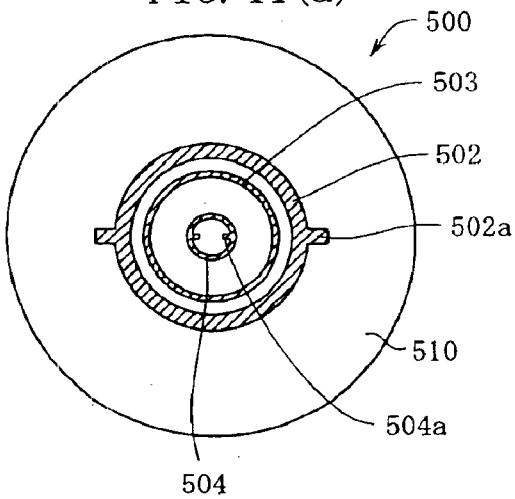
Figure 44C:
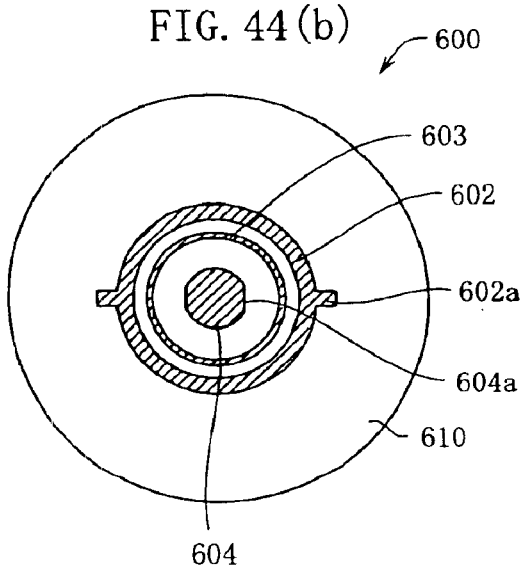

The modified example of a composite antenna shown in FIG. 44(*b*) is a three-frequency composite antenna 500 which is constituted to operate as a 1.5 GHz-band GPS antenna, a 2.5 GHz-band VICS radio wave beacon antenna, and a 5.8 GHz-band DSRC antenna for ETC or similar, for example. A GPS first loop antenna 502 is formed by a print pattern in the upper surface of a dielectric substrate 510 which constitutes the composite antenna 500. The first loop antenna 502 is constituted as a circularly polarized loop antenna as a result of being formed having a pair of first perturbation elements 502*a* that lie opposite each other in an outward direction. A VICS second loop antenna 503 is formed by a print pattern within the first loop antenna 502. The second loop antenna 503 is a linearly polarized antenna. A third loop antenna 504 which operates in the DSRC frequency band is formed by a print pattern substantially in the center of the second loop antenna 503. The third loop antenna 504 is constituted as a circularly polarized loop antenna as a result of being formed having a pair of second perturbation elements 504*a* that lie opposite each other in an outward direction. Further, an earth pattern is formed over the whole of the underside of the dielectric substrate 510. In the case of the composite antenna 500, because the second loop antenna 503 serving as a VICS radio wave beacon, and the third loop antenna 504 which operates in the ETC frequency band are disposed on substantially the same axis within the first loop antenna 502 which operates in the GPS band and is formed on the dielectric substrate 510, a small composite antenna which is capable of operating in three different frequency bands can accordingly be obtained.

The modified example of a composite antenna shown in FIG. (44*c*) is a three-frequency composite antenna 600 which is constituted to operate as a 1.5 GHz-band GPS antenna, a 2.5 GHz-band VICS radio wave beacon antenna, and a 5.8 GHz-band DSRC antenna for ETC or similar, for example. A GPS first loop antenna 602 is formed by a print pattern in the upper surface of a dielectric substrate 610 which constitutes the composite antenna 600. The first loop antenna 602 is constituted as a circularly polarized loop antenna as a result of being formed having a pair of perturbation elements 602*a* that lie opposite each other in an outward direction. A VICS second loop antenna 603 is formed by a print pattern within the first loop antenna 602. The second loop antenna 603 is a linearly polarized antenna. A circular patch antenna 604 which operates in the DSRC frequency band is formed by a print pattern substantially in the center of the second loop antenna 603. The circular patch antenna 604 is constituted as a circularly polarized loop antenna as a result of being formed having a pair of degeneracy separation elements 604*a* that lie opposite each other. Further, an earth pattern is formed over the whole of the underside of the dielectric substrate 610. In the case of the composite antenna 600, because the second loop antenna 603 serving as a VICS radio wave beacon, and the circular patch antenna 604 which operates in the ETC frequency band are disposed on substantially the same axis within the first loop antenna 602 which operates in the GPS band and is formed on the dielectric substrate 610, a small composite antenna which is capable of operating in three different frequency bands can accordingly be obtained.

Figure 45:
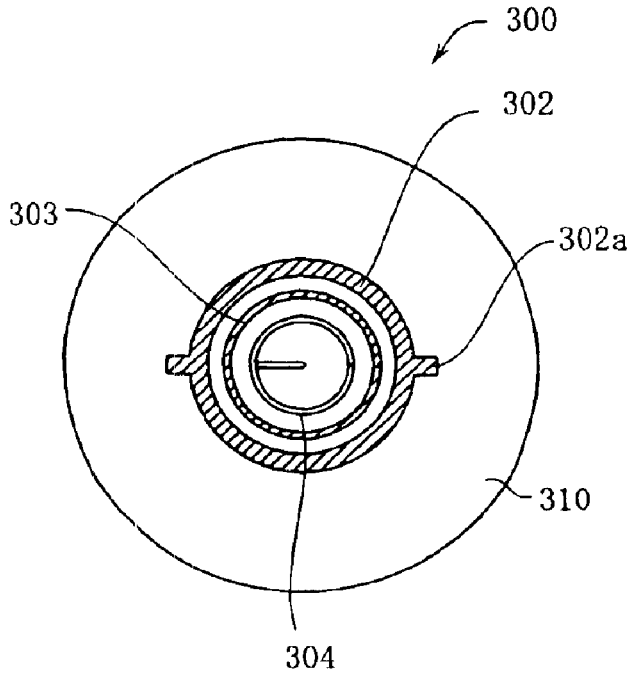
FIG. 45 is a planar view of the constitution of the composite antenna according to a fourth embodiment of the present invention.
Figure 46:
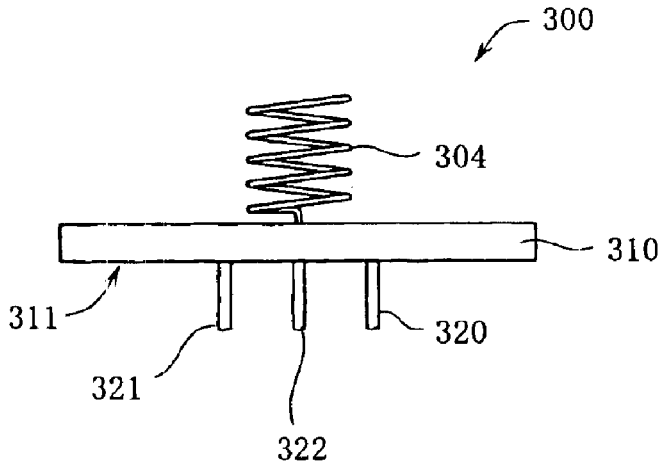
FIG. 46 is a side view of the constitution of the composite antenna according to the fourth embodiment of the present invention.

Next, the constitution of the composite antenna according to the fourth embodiment of the present invention is shown in FIGS. 45 and 46, where FIG. 45 is a planar view of a fourth composite antenna 300 according to the present invention, and FIG. 46 is a side view thereof.

The fourth composite antenna 300 shown in FIGS. 45 to 46 is a three-frequency composite antenna and is constituted to operate as a 1.5 GHz-band GPS antenna, a 2.5 GHz-band VICS radio wave beacon antenna, and a 5.8 GHz-band DSRC antenna for ETC or similar, for example. A GPS first loop antenna 302 is formed by a print pattern in the upper surface of a dielectric substrate 310 which constitutes the composite antenna 300. The first loop antenna 302 is constituted as a circularly polarized antenna as a result of being formed having a pair of perturbation elements 302*a* that lie opposite each other in an outward direction. A VICS second loop antenna 303 is formed by a print pattern within the first loop antenna 302. The second loop antenna 303 is a linearly polarized antenna. A three-frequency composite antenna 400 is constituted to operate as a 1.5 GHz-band GPS antenna, a 2.5 GHz-band VICS radio wave beacon antenna, and a 5.8 GHz-band DSRC antenna for ETC or similar, for example. A GPS first loop antenna 302 is formed by a print pattern in the upper surface of a dielectric substrate 310 which constitutes the composite antenna 300. The first loop antenna 302 is constituted as a circularly polarized antenna as a result of being formed having a pair of perturbation elements 302*a* that lie opposite each other in an outward direction. A VICS second loop antenna 303 is formed by a print pattern within the first loop antenna 302. The second loop antenna 303 is a linearly polarized antenna. Further, an earth pattern 311 is formed over the whole of the underside of the dielectric substrate 310.

Further, an ETC right-handed circularly polarized helical antenna 304 is disposed substantially in the center of the upper surface of the dielectric substrate 310. In this composite antenna 300, the first loop antenna 302 is constituted to operate as a right-handed circularly polarized antenna as a result of electricity being supplied from an arc-shaped first feed pattern (not shown) which is disposed so as to be electromagnetically coupled to this loop antenna. Also, the second loop antenna 303 is constituted to operate as a linearly polarized antenna as a result of electricity being supplied from an arc-shaped short second feed pattern (not shown) which is disposed so as to be electromagnetically coupled to this loop antenna. These feed patterns are disposed so as to be embedded as described earlier within the dielectric substrate 310. A first feed line 320 is connected to the first feed pattern and a second feed line 321 is connected to the second feed pattern, such that the first loop antenna 302 is constituted to operate as a right-handed circularly polarized antenna and the second loop antenna 303 is constituted to operate as a linearly polarized antenna. Further, the helical antenna 304 is constituted by winding wire material in the form of a helix in the direction in which the right-handed circularly polarized antenna operates, and electricity is supplied to this helical antenna from a third feed line 322.

The fourth composite antenna 300 according to the present invention comprises a first loop antenna 302 which is a right-handed circularly polarized loop antenna that operates in the GPS band and which is formed on the dielectric substrate 310. Because this antenna is a loop antenna, the space therein can be utilized. Therefore, in the case of the fourth composite antenna 300 according to the present invention, a second linearly polarized loop antenna 303 which operates in the VICS band is formed within the first loop antenna 302. Also, by utilizing the space in the second loop antenna 303, the helical antenna 304 which operates in the ETC frequency band is disposed so as to be on substantially the same axis as the first loop antenna 302 and the second loop antenna 303. A small composite antenna which is capable of operating in three different frequency bands can accordingly be obtained, and the mount area for the composite antenna 300 can be reduced and handling thereof facilitated.

In the composite antenna according to the present invention described hereinabove, the shape of the dielectric substrate is described as circular. However, the present invention is not limited to or by such a shape, and can be implemented with a multi-sided shape such as a triangle, a rectangle, a hexagon, or an octagon.

Furthermore, in the above description, the composite antenna according to the present invention was constituted to operate as a 1.5 GHz-band GPS antenna, a 2.5 GHz-band VICS radio wave beacon antenna, and a 5.8 GHz-band DSRC antenna for ETC or similar, but is not limited to such a constitution. The outer first loop antenna could be a GPS antenna and the inner second loop antenna a 2.6 GHz-band satellite radio (MSB) antenna, and the inner patch antenna could be a 5.8 GHz-band DSRC antenna for ETC or similar. In addition, the outer first loop antenna could be a 1.2 GHz-band GPS antenna and the inner second loop antenna a 1.5 GHz-band GPS antenna or a 2.5 GHz-band VICS radio wave beacon antenna, and the inner patch antenna could be a 5.8 GHz-band DSRC antenna for ETC or similar. Moreover, in addition to a GPS system, a DSRC system, and a VICS system and so forth, the composite antenna according to the present invention can be applied as an antenna of a plurality of systems among systems that include a satellite communication system, vehicle telephone system, and satellite radio system.

INDUSTRIAL APPLICABILITY

As described above, because, according to the present invention, a second loop antenna which operates in a second frequency band and a patch antenna which operates in a third frequency band are formed within a first loop antenna which operates in a first frequency band, a small composite antenna which operates in three different frequency bands can be obtained. Accordingly, because, according to the present invention, a space in the first loop antenna which operates in the first frequency band is used to form the second loop antenna which operates in the second frequency band and the space in the second loop antenna is used to form a patch antenna which operates in the third frequency band, a small composite antenna can be obtained, and the mount area thereof can be reduced and handling thereof facilitated.

Moreover, because the first loop antenna, second loop antenna and patch antenna are provided on substantially the same axis, it is possible to inhibit the mutual influence of the antennae. In addition, when the patch antenna is provided with degeneracy separation elements, a DSRC circularly polarized antenna for ETC and the like can be implemented, and, by providing the first loop antenna with perturbation elements to constitute a circularly polarized antenna, a GPS antenna can be produced. The second loop antenna can also be a VICS linearly polarized antenna.

What is claimed is:

1. A composite antenna, characterized by comprising:

a first loop antenna which operates in a first frequency band and which is formed in the upper surface of a dielectric substrate;

a second loop antenna which operates in a second frequency band that is higher than the first frequency band and which is formed within the first loop antenna; and a patch antenna which operates in a third frequency band that is higher than the second frequency band and which is formed within the second loop antenna, and characterized in that a first earth pattern for the first loop antenna and second loop antenna is formed in the underside of the dielectric substrate, a recess being formed substantially in the center thereof; and a pattern formed in the bottom face of the recess constitutes a second earth pattern for the patch antenna.

2. The composite antenna according to claim 1, characterized in that the first loop antenna, second loop antenna, and patch antenna are formed on substantially the same axis; the first loop antenna is constituted as a circularly polarized antenna by forming a pair of opposing perturbation elements on the first loop antenna; the second loop antenna is constituted as a linearly polarized antenna; and the patch antenna is constituted as a circularly polarized antenna by forming a pair of opposing degeneracy separation elements on the patch antenna.

3. The composite antenna according to claim 2, characterized in that a third loop antenna which operates in the third frequency band and which comprises perturbation elements is formed in place of the patch antenna.

4. The composite antenna according to claim 2, characterized in that a spiral antenna which operates in the third frequency band is formed in place of the patch antenna.

5. The composite antenna according to claim 1, characterized in that:

the dielectric substrate is formed by combining a plurality of print substrates, respective patterns for the first loop antenna, second loop antenna and patch antenna being formed in the upper surface of a print substrate that lies uppermost;

the second earth pattern is formed in the underside of this substrate so as to lie opposite the patch antenna;

a through-hole for the formation of the recess is formed substantially in the center of an intermediate print substrate, a first feed pattern which is electromagnetically coupled to the first loop antenna and a second feed pattern which is electromagnetically coupled to the second loop antenna being formed an the upper surface of the intermediate print substrate; and a through-hole for the formation of the recess is formed substantially in the center of a print substrate that lies lowermost, the first earth pattern being formed in the underside of this substrate.

6. The composite antenna according to claim 5, characterized in that a third loop antenna which operates in the third frequency band and which comprises perturbation elements is formed in place of the patch antenna.

7. The composite antenna according to claim 5, characterized in that a spiral antenna which operates in the third frequency band is formed in place of the patch antenna.

8. The composite antenna according to claim 1, characterized in that a pattern that connects the second earth pattern and the first earth pattern is formed in the circumferential wall face of the recess.

9. The composite antenna according to claim 8, characterized in that a third loop antenna which operates in the third frequency band and which comprises perturbation elements is formed place of the patch antenna.

10. The composite antenna according to claim 8, characterized in that a spiral antenna which operates in the third frequency band is formed in place of the patch antenna.

11. The composite antenna according to claim 1, characterized in that a third loop antenna which operates in the third frequency band and which comprises perturbation elements is formed in place of the patch antenna.

12. The composite antenna according to claim 1, characterized in that a spiral antenna which operates in the third frequency band is formed in place of the patch antenna.

13. A composite antenna, characterized by comprising:

a first loop antenna which operates in a first frequency band, and which is formed in the upper surface of a dielectric substrate having a recess provided substantially in the center thereof so as to surround the recess;

a second loop antenna which operates in a second frequency band that is higher than the first frequency band, and which is formed within the first loop antenna so as to surround the recess; and a patch antenna which operates in a third frequency band that is higher than the second frequency band and which is formed in the bottom face of the recess, and characterized in that an earth pattern is formed in the underside of the dielectric substrate.

14. The composite antenna according to claim 13, characterized in that the first loop antenna, second loop antenna and patch antenna are formed on substantially the same axis; the first loop antenna is constituted as a circularly polarized antenna by forming a pair of opposing perturbation elements on the first loop antenna; the second loop antenna is constituted as a linearly polarized antenna; and the patch antenna is constituted as a circularly polarized antenna by forming a pair of opposing degeneracy separation elements on the patch antenna.

15. The composite antenna according to claim 14, characterized in that a third loop antenna which operates in the third frequency band and which comprises perturbation elements is formed in place of the patch antenna.

16. The composite antenna according to claim 14, characterized in that a spiral antenna which operates in the third frequency band is formed in place of the patch antenna.

17. The composite antenna according to claim 13, characterized in that:

the dielectric substrate is formed by combining a plurality of print substrates;

a through-hale for the formation of the recess is formed substantially in the center of a print substrate that lies uppermost, respective patterns for the first loop antenna and second loop antenna being formed in the. upper surface of this substrate on substantially the same axis;

a through-hole for the formation of the recess is formed substantially in the center of an intermediate print substrate, a first feed pattern which is electromagnetically coupled to the first loop antenna and a second feed pattern which is electromagnetically coupled to the second loop antenna being formed in the upper surface of the intermediate print substrate; and a pattern for the patch antenna is formed in the upper surface of a print substrate that lies lowermost, the earth pattern being formed in the underside of this substrate.

18. The composite antenna according to claim 17, characterized in that a third loop antenna which operates in the third frequency band and which comprises perturbation elements is formed place of the patch antenna.

19. The composite antenna according to claim 17, characterized in that a spiral antenna which operates in the third frequency band is formed in place of the patch antenna.

20. The composite antenna according to claim 13, characterized in that a third loop antenna which operates in the third frequency band and which comprises perturbation elements is formed in place of the patch antenna.

21. The composite antenna according to claim 13, characterized in that a spiral antenna which operates in the third frequency band is formed in place of the patch antenna.

22. A composite antenna, characterized by comprising:

a first loop antenna which operates in a first frequency band and which is formed in the upper surface of a dielectric substrate;

a second loop antenna which operates in a second frequency band that is higher than the first frequency band and which is formed within the first loop antenna; and a helical antenna which operates in a third frequency band that is higher than the second frequency band and which is formed substantially in the center of the dielectric substrate, and characterized in that an earth pattern is formed in the underside of the dielectric substrate.

23. A composite antenna, characterized by comprising:

a first loop antenna which operates in a first frequency band, and which is formed in the upper surface of a dielectric substrate having a first recess provided substantially in the center thereof so as to surround the first recess;

a second loop antenna which operates in a second frequency band that is higher than the first frequency band, and which is formed within the first loop antenna so as to surround the first recess; and a patch antenna which operates in a third frequency band that is higher than the second frequency band and which is formed in the bottom face of the first recess, and characterized in that a first earth pattern for the first loop antenna and second loop antenna is formed in the underside of the dielectric substrate, a second recess being formed substantially in the center of this substrate, and a pattern formed in the bottom face of the second recess constitutes a second earth pattern for the patch antenna.

24. The composite antenna according to claim 23, characterized in that the first loop antenna, second loop antenna and patch antenna are formed on substantially the same axis; the first loop antenna is constituted as a circularly polarized antenna by forming a pair of opposing perturbation elements on the first loop antenna; the second loop antenna is constituted as a linearly polarized antenna; and the patch antenna is constituted as a circularly polarized antenna by forming a pair of opposing degeneracy separation elements on the patch antenna.

25. The composite antenna according to claim 24, characterized in that a third loop antenna which operates in the third frequency band and which comprises perturbation elements is formed in place of the patch antenna.

26. The composite antenna according to claim 24, characterized in that a spiral antenna which operates in the third frequency band is formed in place of the patch antenna.

27. The composite antenna according to claim 23, characterized in that:

the dielectric substrate is formed by combining a plurality of print substrates;

a through-hole for the formation of the first recess is formed substantially in the center of a print substrate that lies uppermost, respective patterns for the first loop antenna and second loop antenna being formed in the upper surface of this substrate around the through-hole;

a through-hole for the formation of the first recess is formed substantially in the center of a first intermediate print substrate, a first feed pattern which is electromagnetically coupled to the first loop antenna and a second feed pattern which is electromagnetically coupled to the second loop antenna being formed in the upper surface of the first intermediate print substrate;

a pattern for the patch antenna is formed in the upper surface of a second intermediate print substrate, the second earth pattern being formed in the underside of this substrate so as to lie opposite the patch antenna; and a through-hole for the formation of the second recess is formed substantially in the center of a print substrate that lies lowermost, the first earth pattern being formed in the underside of this substrates.

28. The composite antenna according to claim 27, characterized in that a third loop antenna which operates in the third frequency band and which comprises perturbation elements is formed in place of the patch antenna.

29. The composite antenna according to claim 27, characterized in that a spiral antenna which operates an the third frequency band is formed in place of the patch antenna.

30. The composite antenna according to claim 23, characterized in that a pattern that connects the second earth pattern and the first earth pattern is formed in the circumferential wall face of the second recess.

31. The composite antenna according to claim 30, characterized in that a third loop antenna which operates in the third frequency band and which comprises perturbation elements is formed in place of the patch antenna.

32. The composite antenna according to claim 30, characterized in that a spiral antenna which operates in the third frequency band is formed in place of the patch antenna.

33. The composite antenna according to claim 23, characterized in that a third loop antenna which operates in the third frequency band and which comprises perturbation elements is formed in place of the patch antenna.

34. The composite antenna according to claim 23, characterized in that a spiral antenna which operates in the third frequency band is formed in place of the patch antenna.

* * * * *